US009658579B2

(12) United States Patent
Nakamura et al.

(10) Patent No.: US 9,658,579 B2
(45) Date of Patent: May 23, 2017

(54) IMAGE FORMING APPARATUS INCLUDING A TRANSFER BIAS OUTPUT DEVICE

(71) Applicants: Keigo Nakamura, Kanagawa (JP); Haruo Iimura, Kanagawa (JP); Shinji Aoki, Osaka (JP)

(72) Inventors: Keigo Nakamura, Kanagawa (JP); Haruo Iimura, Kanagawa (JP); Shinji Aoki, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/709,567

(22) Filed: May 12, 2015

(65) Prior Publication Data

US 2015/0338792 A1 Nov. 26, 2015

(30) Foreign Application Priority Data

May 23, 2014 (JP) ..... 2014-107150

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1665; G03G 15/1675
USPC ..... 399/66
See application file for complete search history.

(56) References Cited

U.S. PATENT DOCUMENTS

| | | | |
|---|---|---|---|
| 5,595,852 | A | 1/1997 | Shimoda et al. |
| 6,284,424 | B1 | 9/2001 | Iimura et al. |
| 2006/0292470 | A1 | 12/2006 | Iimura |
| 2009/0123168 | A1 | 5/2009 | Aoki et al. |
| 2009/0142087 | A1 | 6/2009 | Iimura |
| 2010/0098446 | A1 | 4/2010 | Ishikawa et al. |
| 2010/0232820 | A1 | 9/2010 | Usami et al. |
| 2010/0284705 | A1 | 11/2010 | Aoki et al. |
| 2011/0058831 | A1 | 3/2011 | Usami et al. |
| 2011/0200348 | A1 | 8/2011 | Aoki |
| 2011/0229168 | A1 | 9/2011 | Shiraishi et al. |

(Continued)

FOREIGN PATENT DOCUMENTS

| | | |
|---|---|---|
| JP | 4-086878 | 3/1992 |
| JP | 9-146381 | 6/1997 |

(Continued)

*Primary Examiner* — Billy Lactaoen
(74) *Attorney, Agent, or Firm* — Harness, Dickey & Pierce, P.L.C.

(57) ABSTRACT

An image forming apparatus includes an image bearer to bear a toner image, a toner image forming device to form the toner image on the image bearer, a nip forming device to contact the image bearer to form a transfer nip between the image bearer and the nip forming device, a transfer bias output device to output a transfer bias including a DC component and an AC component to transfer the toner image from the image bearer onto a recording medium interposed in the transfer nip, and a controller operatively connected to the transfer bias output device to adjust a frequency f of the AC component of the transfer bias in accordance with an image area ratio A such that the frequency f is at its minimum with a predetermined image area ratio Amin %, where Amin % is greater than 0 but lower than an image area ratio of a solid image.

8 Claims, 11 Drawing Sheets

(56) References Cited

U.S. PATENT DOCUMENTS

| | | | | |
|---|---|---|---|---|
| 2011/0255892 | A1 | 10/2011 | Aoki | |
| 2012/0045231 | A1 | 2/2012 | Ogino et al. | |
| 2012/0045237 | A1* | 2/2012 | Aoki | G03G 15/1675 399/66 |
| 2012/0045259 | A1 | 2/2012 | Nakamura et al. | |
| 2012/0224873 | A1 | 9/2012 | Aoki | |
| 2012/0230715 | A1 | 9/2012 | Ogino et al. | |
| 2012/0237234 | A1* | 9/2012 | Sugimoto | G03G 15/1675 399/50 |
| 2012/0243892 | A1 | 9/2012 | Nakamura et al. | |
| 2013/0064559 | A1 | 3/2013 | Nakamura et al. | |
| 2013/0089363 | A1 | 4/2013 | Mimbu et al. | |
| 2013/0121734 | A1 | 5/2013 | Aoki | |
| 2013/0136468 | A1 | 5/2013 | Shimizu et al. | |
| 2013/0142531 | A1 | 6/2013 | Sugimoto et al. | |
| 2013/0148993 | A1 | 6/2013 | Aoki et al. | |
| 2013/0164011 | A1 | 6/2013 | Nakamura et al. | |
| 2013/0177329 | A1 | 7/2013 | Tanaka et al. | |
| 2013/0195483 | A1 | 8/2013 | Shimizu et al. | |
| 2013/0236201 | A1 | 9/2013 | Mizutani et al. | |
| 2013/0294791 | A1 | 11/2013 | Nakamura | |
| 2013/0308968 | A1 | 11/2013 | Tanaka et al. | |
| 2014/0010562 | A1 | 1/2014 | Tanaka et al. | |
| 2014/0029988 | A1 | 1/2014 | Shimizu et al. | |
| 2014/0079418 | A1 | 3/2014 | Tanaka et al. | |
| 2014/0079423 | A1 | 3/2014 | Shiraishi et al. | |
| 2014/0169817 | A1 | 6/2014 | Sugimoto et al. | |
| 2014/0248064 | A1 | 9/2014 | Tanaka et al. | |
| 2014/0270830 | A1 | 9/2014 | Nakamura et al. | |

FOREIGN PATENT DOCUMENTS

| | | |
|---|---|---|
| JP | 2006-267486 | 10/2006 |
| JP | 2008-058585 | 3/2008 |
| JP | 2008-185890 | 8/2008 |
| JP | 2012-063746 | 3/2012 |

* cited by examiner

IMAGE FORMING APPARATUS INCLUDING A TRANSFER BIAS OUTPUT DEVICE

CROSS-REFERENCE TO RELATED APPLICATIONS

This patent application is based on and claims priority pursuant to 35 U.S.C. §119 to Japanese Patent Application No. 2014-107150, filed on May 23, 2014, in the Japan Patent Office, the entire disclosure of which is hereby incorporated by reference herein.

BACKGROUND

Technical Field

Exemplary aspects of the present disclosure generally relate to an image forming apparatus in which a toner image on an image bearer is transferred onto a recording medium in a transfer nip formed between the image bearer and an abutment part.

Description of the Related Art

There is known an image forming apparatus using an electrophotographic method in which a toner image is transferred from an image bearer onto a recording medium in a transfer nip between the image bearer and an abutment part. The surface of a recording medium is not necessarily smooth. That is, the surface of a recording medium can range from very rough to smooth. In general, toner is not transferred well to embossed surfaces, in particular recessed portions of the surface. This improper transfer of the toner appears as black sports or white spots in the resulting output image.

SUMMARY

In view of the foregoing, in an aspect of this disclosure, there is provided a novel image forming apparatus including an image bearer, a toner image forming device, a nip forming device, a transfer bias output device, and a controller. The image bearer bears a toner image. The toner image forming device forms the toner image on the image bearer. The nip forming device contacts the image bearer to form a transfer nip between the image bearer and the nip forming device. The transfer bias output device outputs a transfer bias including a direct current (DC) component and an alternating current (AC) component to transfer the toner image from the image bearer onto a recording medium interposed in the transfer nip. The controller is operatively connected to the transfer bias output device to adjust a frequency f of the AC component of the transfer bias in accordance with an image area ratio A such that the frequency f is at its minimum with a predetermined image area ratio Amin %, where Amin % is greater than 0 but lower than an image area ratio of a solid image.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
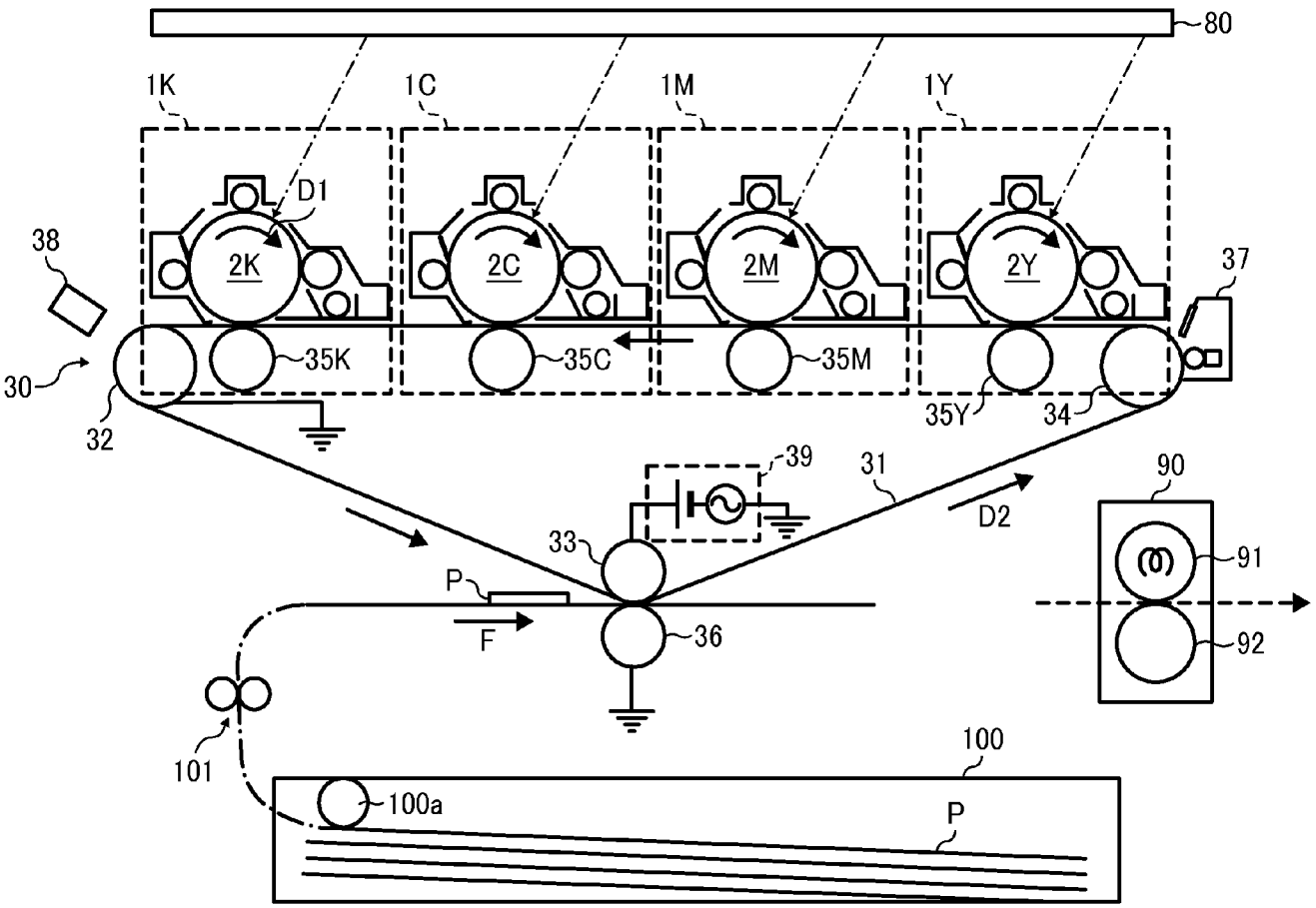
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

In order to facilitate an understanding of the novel features of the present invention, as a comparison, a description is provided comparative examples of image forming apparatuses.

Referring now to the drawings, wherein like reference numerals designate identical or corresponding parts throughout the several views, exemplary embodiments of the present patent disclosure are described.

With reference to FIG. 1, a description is provided of an electrophotographic color printer as an example of an image forming apparatus according to an illustrative embodiment of the present disclosure.

FIG. 1 is a schematic diagram illustrating a printer as an example of the image forming apparatus. As illustrated in FIG. 1, the image forming apparatus includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus also includes a transfer unit 30 serving as a transfer device, an optical writing unit 80, a fixing device 90, a sheet cassette 100, and a pair of registration rollers 101.

The image forming units 1Y, 1M, 1C, and 1K all have the same configuration as all the others, differing only in the color of toner employed. Thus, a description is provided of the image forming unit 1K for forming a toner image of black as a representative example of the image forming units 1Y, 1M, 1C, and 1K. The image forming units 1Y, 1M, 1C, and 1K are replaced upon reaching their product life cycles.

Figure 2:
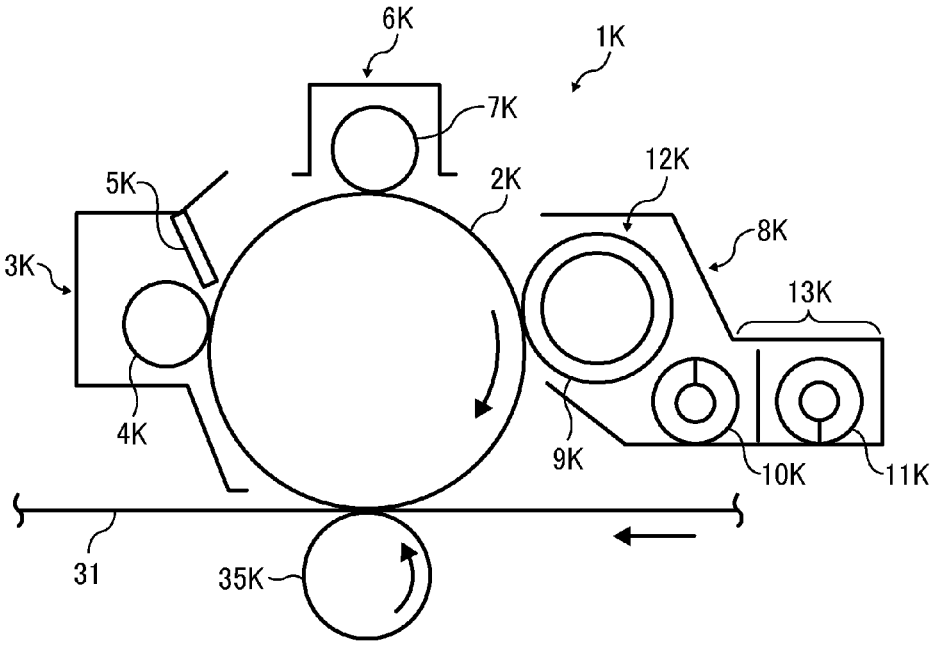
FIG. 2 is a schematic diagram illustrating an image forming unit for the color black as a representative example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. The image forming unit 1K includes a photoconductor 2K serving as a latent image bearing member. The photoconductor 2K is surrounded by various pieces of imaging equipment, such as a charging device 6K, a developing device 8K, a photoconductor cleaner 3K, and a charge remover. These devices are held in a common holder so that they are detachably attachable and replaced at the same time.

The photoconductor 2K comprises a drum-shaped base on which an organic photosensitive layer is disposed, with the external diameter of approximately 60 mm. The photoconductor 2K is rotated in a clockwise direction indicated by arrow D1 by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present illustrative embodiment, the photoconductor 2K is uniformly charged with a negative polarity which is the same polarity as that of normally-charged toner.

As a charging bias, an alternating current (AC) component superimposed on a direct current (DC) component is employed. The charging roller 7K is comprised of a metal cored bar coated with a conductive elastic layer made of a conductive elastic material. According to the present embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image in black color, is formed. As will be described later, the toner image is transferred primarily onto an intermediate transfer belt 31 that travels in a direction indicated by arrow D2.

The photoconductor cleaner 3K removes residual toner remaining on the photoconductor 2K after a primary transfer process, that is, after the photoconductor 2K passes through a primary transfer nip between the intermediate transfer belt 31 and the photoconductor 2K. The photoconductor cleaner 3K includes a brush roller 4K and a cleaning blade 5K. The cleaning blade 5K is cantilevered, that is, one end of the cleaning blade 5K is fixed to the housing of the photoconductor cleaner 3K, and the other end, which is a free end, contacts the surface of the photoconductor 2K. The brush roller 4K rotates and brushes off the residual toner from the surface of the photoconductor 2K while the cleaning blade 5K removes the residual toner by scraping. It is to be noted that the cantilevered side of the cleaning blade 5K is positioned downstream from its free end contacting the photoconductor 2K in the direction of rotation of the photoconductor 2K so that the free end of the cleaning blade 5K faces or becomes counter to the direction of rotation.

The charge remover removes residual electrical charges remaining on the photoconductor 2K after the surface thereof is cleaned by the photoconductor cleaner 3K in preparation for the subsequent imaging cycle.

The developing device 8K includes a developing portion 12K and a developer conveyor 13K. The developing portion 12K includes a developing roller 9K inside thereof. The developer conveyor 13K mixes a developing agent for black and transports the developing agent. The developer conveyor 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10K and the second screw 11K in the axial direction is rotatably held by a shaft bearing.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical fighting and carries the developing agent from the distal end to the proximal end of the screw in the direction perpendicular to the surface of the drawing while rotating. The first screw 10K is disposed parallel to and facing the developing roller 9K. Hence, the developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K in FIG. 2 passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density detector for detecting the density of toner in the developing agent is disposed at the bottom of a casing of the chamber. As the toner density detector, a magnetic permeability detector is employed. There is a correlation between the toner density and the magnetic permeability of the developing agent consisting of toner and magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing devices 8. The controller of the image forming apparatus includes a Random Access Memory (RAM) to store a target output voltage Vtref for output voltages provided by the toner density detectors for yellow, magenta, cyan, and black. If the difference between the output voltages provided by the toner density detectors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8K.

The developing roller 9K in the developing section 12K faces the first screw 10K as well as the photoconductor 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed so as not to rotate together with the developing sleeve. The developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as toner. The developing bias is greater than the bias of the electrostatic latent image on the photoconductor 2K, but less than the charging potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A non-developing potential acts between the developing sleeve and the non-image formation areas of the photoconductor 2K, causing the toner on the developing sleeve to move to the sleeve surface. Due to the developing potential and the non-developing potential, the toner on the developing sleeve moves selectively to the electrostatic latent image formed on the photoconductor 2K, thereby developing the electrostatic latent image into a visible image, known as a toner image.

Similar to the image forming unit 1K, toner images of yellow, magenta, and cyan are formed on the photoconductors 2Y, 2M, and 2C of the image forming units 1Y, 1M, and 1C, respectively.

The optical writing unit 80 for writing a latent image on the photoconductors 2 is disposed above the image forming units 1Y, 1M, 1C, and 1K. Based on image information received from an external device such as a personal computer (PC), the optical writing unit 80 illuminates the photoconductors 2Y, 2M, 2C, and 2K with a light beam projected from a laser diode of the optical writing unit 80. Accordingly, the electrostatic latent images of yellow, magenta, cyan, and black are formed on the photoconductors 2Y, 2M, 2C, and 2K, respectively. More specifically, the potential of the portion of the charged surface of the photoconductor 2Y irradiated with the light beam is attenuated. The potential of the irradiated portion of the photoconductor 2 is less than the potential of other areas, that is, the background portion (non-image portion), thereby forming the electrostatic latent image on the photoconductor 2Y.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a drive roller 32, a secondary-transfer back surface roller 33, a cleaning auxiliary roller 34, four primary transfer rollers 35Y, 35M, 35C, and 35K (which may be referred to collectively as primary transfer rollers 35) as transfer devices, a nip forming roller (which may be referred to as a secondary transfer roller) 36, a belt cleaning device 37, a density detector 38, and so forth. The primary transfer rollers 35Y, 35M, 35C, and 35K are disposed opposite the photoconductors 2Y, 2M, 2C, and 2K, respectively, via the intermediate transfer belt 31.

The intermediate transfer belt 31 is entrained about and stretched taut between the drive roller 32, the secondary-transfer back surface roller 33, the cleaning auxiliary roller 34, and the primary transfer rollers 35Y, 35M, 35C, and 35K (which may be collectively referred to as the primary transfer rollers 35, unless otherwise specified.) The drive roller 32 is rotated in the counterclockwise direction by a motor or the like, and rotation of the driving roller 32 enables the intermediate transfer belt 31 to rotate in the same direction.

The intermediate transfer belt 31 has the following characteristics. The intermediate transfer belt 31 has a thickness in a range of from 20 μm to 200 μm, preferably, approximately 60 μm. The volume resistivity thereof is in a range of from 1e6 Ω·cm to 1e12 Ω·cm, preferably, approximately 1e9 Ω·cm. The volume resistivity is measured with an applied voltage of 100V by a high resistivity meter, Hiresta UPM-CPHT 45 manufactured by Mitsubishi Chemical Corporation. A tensile modulus is approximately 2.6 Gpa. The intermediate transfer belt 31 is made of resin such as polyimide resin in which carbon is dispersed.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface and the image bearing surface of the intermediate transfer belt 31 and the photoconductors 2Y, 2M, 2C, and 2K that contact the intermediate transfer belt 31. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

The toner image for yellow formed on the photoconductor 2Y enters the primary transfer nip for yellow as the photoconductor 2Y rotates. Subsequently, the toner image is transferred from the photoconductor 2Y to the intermediate transfer belt 31 by the transfer electric field and the nip pressure. As the intermediate transfer belt 31 on which the toner image of yellow is transferred passes through the primary transfer nips of magenta, cyan, and black, accordingly, the toner images on the photoconductors 2M, 2C, and 2K are transferred on top of the toner image of yellow, thereby forming a composite toner image on the intermediate transfer belt 31 in the primary transfer process. With this configuration, the color composite toner image is formed on the intermediate transfer belt 31 in the primary transfer process.

Each of the primary transfer rollers 35Y, 35M, 35C, and 35K is an elastic roller comprised of a metal cored bar on which a conductive sponge layer is fixated. The outer diameter of the primary transfer rollers 35Y, 35M, 35C, and 35K is approximately 16 mm. The diameter of the metal cored bar is approximately 10 mm. The resistance R is approximately 3E7Ω. The resistance of the sponge layer is measured such that a metal roller having an outer diameter of 30 mm is pressed against the sponge layer at a load of 10 N and a voltage of 1000 V is supplied to the metal cored bar of the primary transfer roller 35.

The resistance R is obtained by Ohm's law R=V/I, where V is a voltage, I is a current, and R is a resistance. The resistance R of the sponge layer thus obtained is approximately 3E7Ω. A primary transfer bias under constant current control is applied to the primary transfer rollers 35Y, 35M, 35C, and 35K. According to the present illustrative embodiment, a roller-type primary transfer device is used as the primary transfer rollers 35Y, 35M, 35C, and 35K. Alternatively, in some embodiments, a transfer charger and a brush-type transfer device are employed as a primary transfer device.

The nip forming roller 36 of the transfer unit 30 is disposed outside the loop formed by the intermediate transfer belt 31, opposite the secondary-transfer back surface roller 33. The intermediate transfer belt 31 is interposed between the secondary-transfer back surface roller 33 and the nip forming roller 36. Accordingly, a secondary transfer nip is formed between the peripheral surface or the image bearing surface of the intermediate transfer belt 31 and the nip forming roller 36 contacting the surface of the intermediate transfer belt 31.

According to the present illustrative embodiment, the nip forming roller 36 is grounded, and a secondary transfer bias is applied to the secondary-transfer back surface roller 33 by a secondary transfer bias power source 39. With this configuration, a secondary transfer electric field is formed between the secondary-transfer back surface roller 33 and the nip forming roller 36. The secondary transfer electric field causes the toner having a negative polarity to move electrostatically from the secondary-transfer back surface roller side to the nip forming roller side.

As illustrated in FIG. 1, the sheet cassette 100 storing a sheaf of recording media sheets P is disposed below the transfer unit 30. The sheet cassette 100 is equipped with a feed roller 100*a* to contact the top sheet of the sheaf of recording media sheets P. As the feed roller 100*a* is rotated at a predetermined speed, the sheet feed roller 100*a* picks up the top sheet of the recording media sheets P and sends it to a paper delivery passage. Substantially at the end of the paper delivery passage, a pair of registration rollers 101 is disposed.

The pair of the registration rollers 101 stops rotating temporarily as soon as the recording medium P is interposed therebetween. The pair of registration rollers 101 starts to rotate again to feed the recording medium P to the secondary transfer nip in appropriate timing such that the recording medium P is aligned with the composite toner image formed on the intermediate transfer belt 31 in the secondary transfer nip. In the secondary transfer nip, the recording medium P tightly contacts the composite toner image on the intermediate transfer belt 31, and the composite toner image is transferred onto the recording medium P by the secondary transfer electric field and the nip pressure applied thereto. The recording medium P, on which the composite color toner image is formed, passes through the secondary transfer nip N and separates from the nip forming roller 36 and the intermediate transfer belt 31 due to the curvature.

The secondary-transfer back surface roller 33 has the following characteristics. The secondary-transfer back surface roller 33 is formed of a metal cored bar on which a conductive nitrile rubber (NBR) layer is disposed. The outer diameter thereof is approximately 24 mm. The diameter of the metal cored bar of the secondary-transfer back surface roller 33 is approximately 16 mm. The resistance R of the conductive NBR rubber layer is in a range of from 1e6Ω to 1e12Ω, preferably, approximately 4E7Ω. The resistance R is measured using the same method as the primary transfer roller 35 described above.

The nip forming roller 36 has the following characteristics. The nip forming roller 36 is formed of a metal cored bar on which a conductive NBR rubber layer is disposed. The outer diameter of the nip forming roller 36 is approximately 24 mm. The diameter of the metal cored bar is approximately 14 mm. The resistance R of the conductive NBR rubber layer is equal to or less than 1E6Ω. The resistance R is measured using the same method as the primary transfer roller 35 described above.

According to the present illustrative embodiment, the secondary transfer bias power source 39 serving as a secondary transfer bias output device includes a direct current (DC) power source and an alternating current (AC) power source, and an AC component superimposed on a DC component is output as the secondary transfer bias. The DC component is output under constant current control.

As illustrated in FIG. 1, a paper separator is disposed downstream from the nip forming roller 36 in the direction of paper conveyance to support separation of the recording medium. The paper separator includes a charge eliminating needle having serration on the tip thereof. The tip of the charge eliminating needle contacts the recording medium P fed from the secondary transfer nip and applies the recording medium P a separation bias in which the DC component is superimposed on the AC component.

An output terminal of the secondary transfer bias power source 39 is connected to the metal cored bar of the nip forming roller 36. The potential of the metal cored bar of the nip forming roller 36 has a similar or the same value as the output voltage output from the secondary transfer bias power source 39. As for the secondary-transfer back surface roller 33, the metal cored bar thereof is grounded. According to the present illustrative embodiment, the nip forming roller 36 is grounded while the superimposed bias is applied to the metal cored bar of the secondary-transfer back surface roller 33.

Alternatively, in some embodiments, the metal cored bar of the secondary-transfer back surface roller 33 is grounded while the superimposed bias is applied to the metal cored bar of the nip forming roller 36. In this case, the polarity of the DC voltage is changed. More specifically, as illustrated in FIG. 1, when the superimposed bias is applied to the secondary-transfer back surface roller 33 while the toner has a negative polarity and the nip forming roller 36 is grounded, the DC voltage having the same negative polarity as the polarity of toner is used so that a time-averaged potential of the superimposed bias has the same negative polarity as the toner.

By contrast, in a case in which the secondary-transfer back surface roller 33 is grounded and the superimposed bias is applied to the nip forming roller 36, the DC voltage having the positive polarity opposite that of the toner is used so that the time-averaged potential of the superimposed bias has the positive polarity which is opposite that of the toner. Instead of applying the superimposed bias to the secondary-transfer back surface roller 33 or to the nip forming roller 36, the DC voltage may be supplied to one of the secondary-transfer back surface roller 33 and the nip forming roller 36, and the AC voltage may be supplied to the other roller. As will be described later with reference to FIG. 3, in the present illustrative embodiment, as an AC component or an AC voltage of the secondary transfer bias, an AC component or AC voltage having a sinusoidal wave is used.

Alternatively, in some embodiments, an AC component or an AC voltage having a square wave is used. When using a normal sheet of paper as a recording medium, such as the one having a relatively smooth surface, a pattern of dark and light according to the surface conditions of the recording medium is less likely to appear on the recording medium. In this case, the secondary transfer bias including only the DC voltage can be supplied. By contrast, when using paper having a coarse surface such as pulp paper and embossed paper, the secondary transfer bias needs to be changed from the transfer bias consisting only of the DC voltage to the superimposed bias.

After the intermediate transfer belt 31 passes through the secondary transfer nip N, residual toner not having been transferred onto the recording medium P remains on the intermediate transfer belt 31. The toner residues are removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density detector 38 is disposed outside the loop formed by the intermediate transfer belt 31. More specifically, the density detector 38 faces a portion of the intermediate transfer belt 31 wound around the drive roller 32 with a gap of approximately 4 mm between the density detector 38 and the intermediate transfer belt 31. An amount of toner adhered to the toner image primarily transferred onto the intermediate transfer belt 31 is measured when the toner image comes to the position opposite the density detector 38.

In FIG. 1, on the right side of the secondary transfer nip between the nip forming roller 36 and the intermediate transfer belt 31, the fixing device 90 is disposed. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording medium P in the fixing nip. Subsequently, the recording medium P is output outside the image forming apparatus from the fixing device 90 via a post-fixing delivery path after the fixing process.

In the case of monochrome imaging, a support plate supporting the primary transfer rollers 35Y, 35M, and 35C of the transfer unit 30 is moved to separate the primary transfer rollers 35Y, 35M, and 35C from the photoconductors 2Y, 2M, and 2C. With this configuration, the outer peripheral surface of the intermediate transfer belt 31, that is, the image bearing surface, is separated from the photoconductors 2Y, 2M, and 2C so that the intermediate transfer belt 31 contacts only the photoconductor 2K for black color. In this state, only the image forming unit 1K is activated to form a toner image of the color black on the photoconductor 2K.

Figure 3:
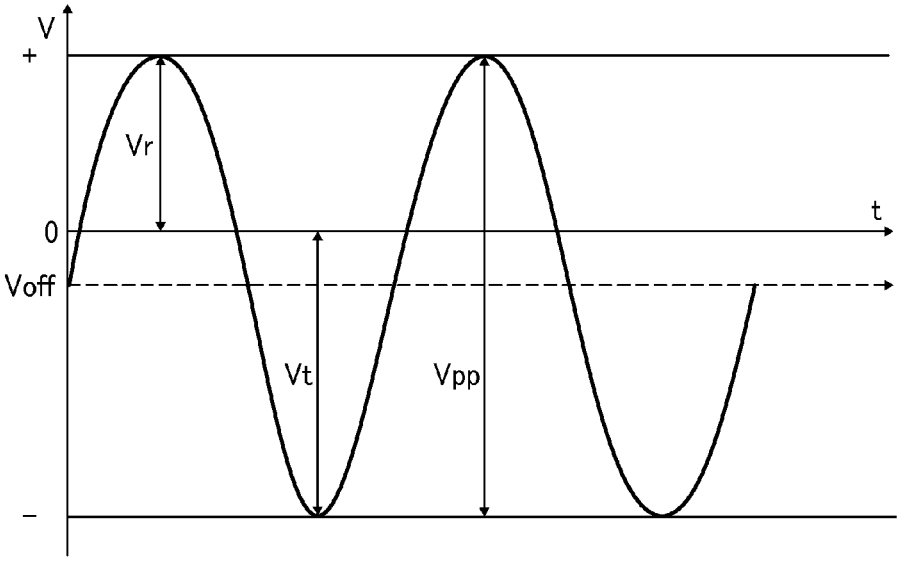
FIG. 3 is a waveform chart showing an example of a waveform of a secondary transfer bias applied to a nip forming roller employed in the image forming apparatus.

With reference to FIG. 3, a description is provided of the secondary transfer bias including the superimposed bias. FIG. 3 is a waveform chart showing a waveform of the secondary transfer bias, which is a superimposed bias, output from the secondary transfer bias power source 39. As described above, the secondary transfer bias is supplied to the metal cored bar of the secondary-transfer back surface roller 33. The secondary transfer bias power source 39 serving as a voltage output device serves as a transfer bias application device that applies a secondary transfer bias. Furthermore, as described above, when the secondary transfer bias is applied to the metal cored bar of the secondary-transfer back surface roller 33, a potential difference is generated between the metal cored bar of the secondary-transfer back surface roller 33 serving as a first transfer member and the metal cored bar of the nip forming roller 36 serving as a second transfer member. In other words, the secondary transfer bias power source 39 serves also as a potential difference generator.

In general, a potential difference is treated as an absolute value. However, in this specification, the potential difference is expressed with polarity. More specifically, a value obtained by subtracting a potential of the metal cored bar of the nip forming roller 36 from a potential of the metal cored bar of the secondary-transfer back surface roller 33 is treated as the potential difference. Using toner having the negative polarity as in the illustrative embodiments, when the polarity of the time-averaged value of the potential difference becomes negative, the potential of the nip forming roller 36 is increased beyond the potential of the secondary-transfer back surface roller 33 towards the opposite polarity side (the positive side in the present embodiment) to the polarity of charge on the toner. Accordingly, the toner is electrostatically moved from the secondary-transfer back surface roller side to the nip forming roller side.

In FIG. 3, an offset voltage Voff is a value of the DC component of the secondary transfer bias. A peak-to-peak voltage Vpp is a peak-to-peak voltage of the AC component of the secondary transfer bias. According to the illustrative embodiment, the superimposed bias consists of a superimposed voltage in which the offset voltage Voff and the peak-to-peak voltage Vpp are superimposed. Thus, the time-averaged value of the secondary transfer bias coincides with the offset voltage Voff.

As described above, according to the illustrative embodiment, the secondary transfer bias is applied to the metal cored bar of the secondary-transfer back surface roller 33 while the metal cored bar of the nip forming roller 36 is grounded (0 V). Thus, the potential of the metal cored bar of the secondary-transfer back surface roller 33 becomes the potential difference between the potentials of the metal cored bar of the secondary-transfer back surface roller 33 and the metal cored bar of the nip forming roller 36. The potential difference between the potentials of the metal cored bar of the secondary-transfer back surface roller 33 and the metal cored bar of the nip forming roller 36 consists of a direct current (DC) component having the same value as the offset voltage Voff and an alternating current (AC) component having the same value as the peak-to-peak voltage (Vpp).

According to the present illustrative embodiment, as illustrated in FIG. 3, the polarity of the offset voltage Voff is negative. According to the present illustrative embodiment, when the polarity of the offset voltage Voff of the secondary transfer bias applied to the secondary-transfer back surface roller 33 is negative, the toner having the negative polarity is repelled by the secondary-transfer back surface roller 33 and drawn relatively to the nip forming roller side.

When the polarity of the secondary transfer bias is negative so is the polarity of the toner, the toner of negative polarity is pushed out electrostatically from the secondary-transfer back surface roller side to the nip forming roller side in the secondary transfer nip. Accordingly, the toner on the intermediate transfer belt 31 is transferred onto the recording medium P.

By contrast, when the polarity of the secondary transfer bias is opposite that of the toner, that is, the polarity of the secondary transfer bias is positive, the toner having the negative polarity is attracted electrostatically to the secondary-transfer back surface roller side from the nip forming roller side. Consequently, the toner transferred to the recording medium P is attracted again to the intermediate transfer belt 31. It is to be noted that because the time-averaged value Vave of the secondary transfer bias (the same value as the offset voltage Voff in the present embodiment) has the negative polarity, the toner is relatively moved electrostatically from the secondary-transfer back surface roller side to the nip forming roller side.

In FIG. 3, a return peak potential Vr represents a positive peak value having the polarity opposite that of the toner in the secondary transfer bias. A transfer peak potential Vt represents a negative peak value having the same polarity as that of the toner in the secondary transfer bias.

A secondary transfer electric field consisting of an alternating electric field is formed in the secondary transfer nip, thereby causing toner particles to move back and force between the surface of the intermediate transfer belt 31 and the surface of the recording medium P. More specifically, the AC component of the alternating electric field is capable of reversing the polarity at a predetermined cycle.

According to the present illustrative embodiment, as the AC component of the secondary transfer bias, an AC component having a sinusoidal wave is employed. However, the waveform of the AC component is not limited to the sinusoidal wave. Alternatively, in some embodiments, an AC voltage having a waveform different from the sinusoidal wave is used. For example, an AC voltage having a square wave, a triangle wave, a trapezoid wave, or the like can be used.

Figure 4:
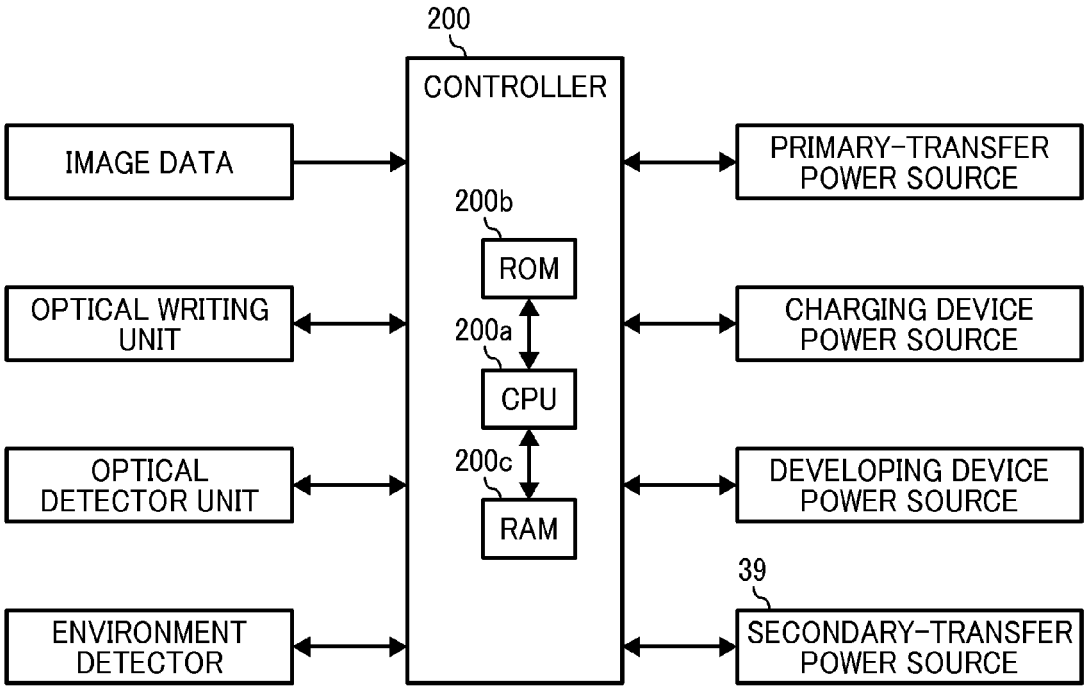
FIG. 4 is a block diagram illustrating a control system of the image forming apparatus.

FIG. 4 is a block diagram illustrating a portion of an electrical circuit of the image forming apparatus according to an illustrative embodiment of the present disclosure.

As illustrated in FIG. 4, a controller 200 includes a Central Processing Unit (CPU) 200*a* serving as an operation device, a Random Access Memory (RAM) 200*c* serving as a nonvolatile memory, and a Read Only Memory (ROM) 200*b* serving as a temporary storage device, and so forth. The controller 200 for controlling the entire image forming apparatus is connected operatively to a variety of devices and sensors via signal lines. For simplicity, FIG. 4 illustrates only the devices associated with the characteristic configuration of the image forming apparatus of the illustrative embodiments of the present disclosure.

Based on a control program stored in the RAM 200*c* and a ROM 200*b*, the controller 200 drives each device and carries out various data processing. The data processing, includes, for example, calculation of an image area ratio of each of the toner images based on image data provided by an external device such as a personal computer or the like, and calculation of a sum of the image area ratios as the image area ratio of an area of the intermediate transfer belt 31 immediately before the secondary transfer nip.

Furthermore, the controller 200 calculates a frequency of the AC component of the secondary transfer bias based on the image area ratio thus obtained. Subsequently, based on the result, the controller 200 controls the secondary transfer bias power source 39 to obtain the secondary transfer bias having a desired waveform. Relations between the image area ratio and the frequency of the AC component of the secondary transfer bias employed in the calculation are described later.

The surface of the intermediate transfer belt 31 in the sub-scanning direction (i.e., a traveling direction of the surface of the photoconductor and the intermediate transfer belt) is theoretically segmented into regions, each region having 50 pixels, from the leading end of a page. Each segment (hereinafter referred to as a 50-line segment) includes, in the main scanning direction, 50 lines of a pixel line consisting of a group of pixels. For each pixel line, a ratio of pixels in an image portion (composite toner image) to a total pixels is obtained as an image area ratio. An average of the image area ratios of the 50 pixel lines serves as the image area ratio of the 50-line segment.

Figure 5B:
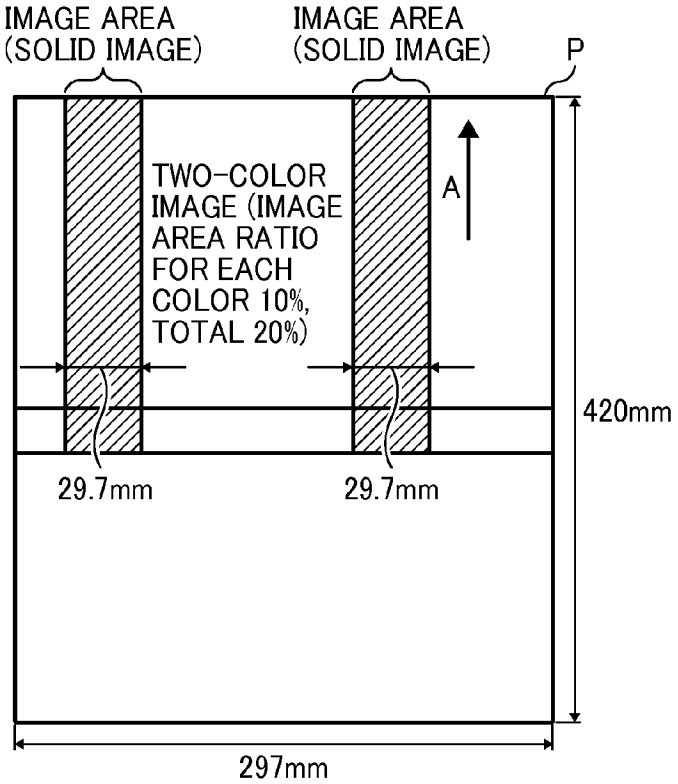
FIG. 5B is a schematic diagram illustrating a second example of a toner image formed on an A3-size recording medium.
Figure 5A:
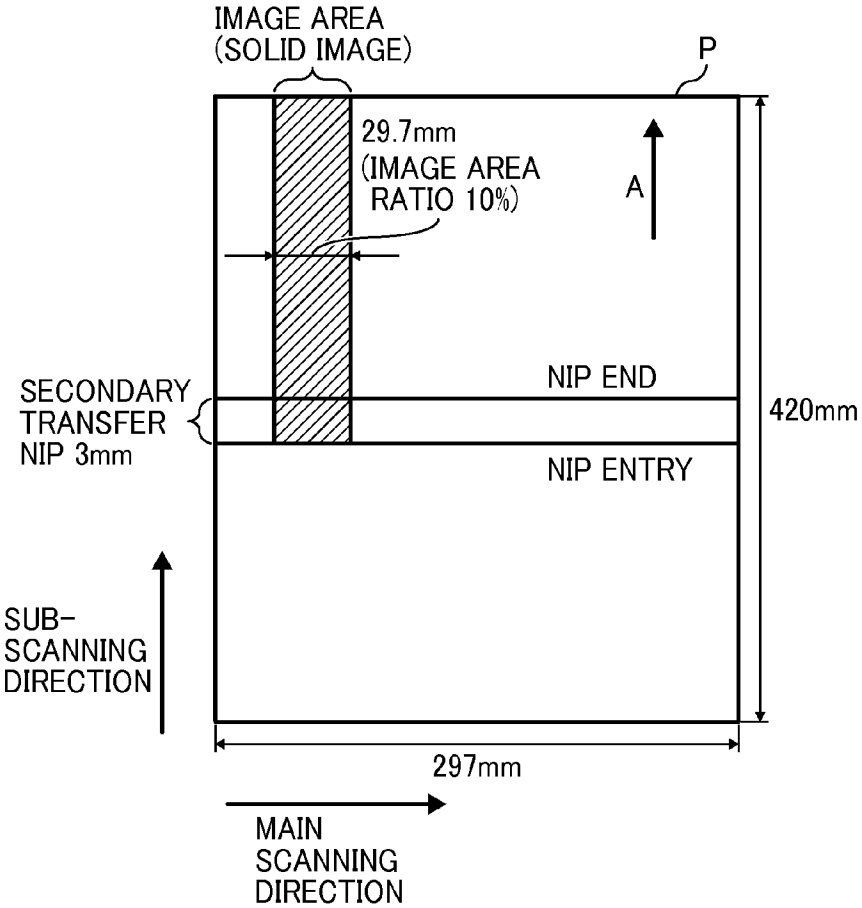
FIG. 5A is a schematic diagram illustrating a first example of a toner image formed on an A3-size recording medium.

FIG. 5A is a schematic diagram illustrating a first example of a toner image formed on an A3-size recording medium. FIG. 5B is a schematic diagram illustrating a second example of a toner image formed on an A3-size recording medium P. In the secondary transfer nip, the recording medium P is transported in a direction indicated by an arrow F. According to the present illustrative embodiment, the width of the intermediate transfer belt 31 is slightly wider than the length of the shorter side (297 mm) of A3-size recording medium P. The secondary transfer nip is a place of contact at which the intermediate transfer belt 31 and the nip forming roller 36 contact. The length of the nip forming roller 36 is greater than the width of the intermediate transfer belt 31. Therefore, the length of the secondary transfer nip in the width direction of the intermediate transfer belt 31 coincides with the width of the intermediate transfer belt 31, which is slightly larger than the short side of A3-size recording medium P.

It is to be noted that the controller 200 of the present illustrative embodiment calculates the image area ratio of the 50-line segment on the intermediate transfer belt 31, assuming, for the sake of convenience, that the length of the secondary transfer nip in the width direction of the intermediate transfer belt 31 is the same length as the short side of A3-size recording medium P. The width of the secondary transfer nip in the traveling direction (sub-scanning direction) of the intermediate transfer belt 31 is approximately 3 mm.

In FIG. 5A, a toner image in a form of a short strip extending in the transport direction of the recording medium P is formed. The length of the toner image in the transport direction of the recording medium P is approximately 220 mm, which is approximately half the size of the recording medium P in the longitudinal direction thereof. As illustrated in FIG. 5A, the length of the recording medium P in the longitudinal direction is approximately 420 mm. The toner image is a solid image using a single color toner among yellow, magenta, cyan, and black. The length of toner image in the direction of the short side of the recording medium P is 29.7 mm, which is 1/10 of the length of the secondary transfer nip of 297 mm in the width direction of the secondary transfer nip.

Here, for the sake of convenience, the length of the secondary transfer nip in the width direction of the intermediate transfer belt 31 is 297 mm. Therefore, the image area ratio of the 50-line segment including the above described toner image in the transport direction of the recording medium is 10%.

FIG. 5B is a schematic diagram illustrating the second example of a toner image formed on an A3-size recording medium. In FIG. 5B, two toner images in a form of a short strip extending in the transport direction of the recording medium P are formed with a certain space therebetween in the direction perpendicular to the transport direction of the recording medium P. The length of the toner images in the transport direction of the recording medium P is approximately 220 mm, and the toner images are formed within the same area in the longitudinal direction of the recording medium P. Two toner images are solid images in two different single colors. The length of the toner images in the short side direction is 29.7 mm. Therefore, the image area ratio of the 50-line segment including the above described toner images in the transport direction of the recording medium is 20%.

According to the present illustrative embodiment, the image area ratio of the 50-line segment is a sum of image area ratios for yellow, magenta, cyan, and black. Thus, for example, even when two toner images are not formed separately, that is, two toner images are superimposed one atop the other, the image area ratio of the 50-line segment for the superimposed toner image is 20%, not 10%.

Next, a description is provided of relations of the toner adhesion amount of a toner image and the number of back-and-forth movements of toner particles.

Figure 6:
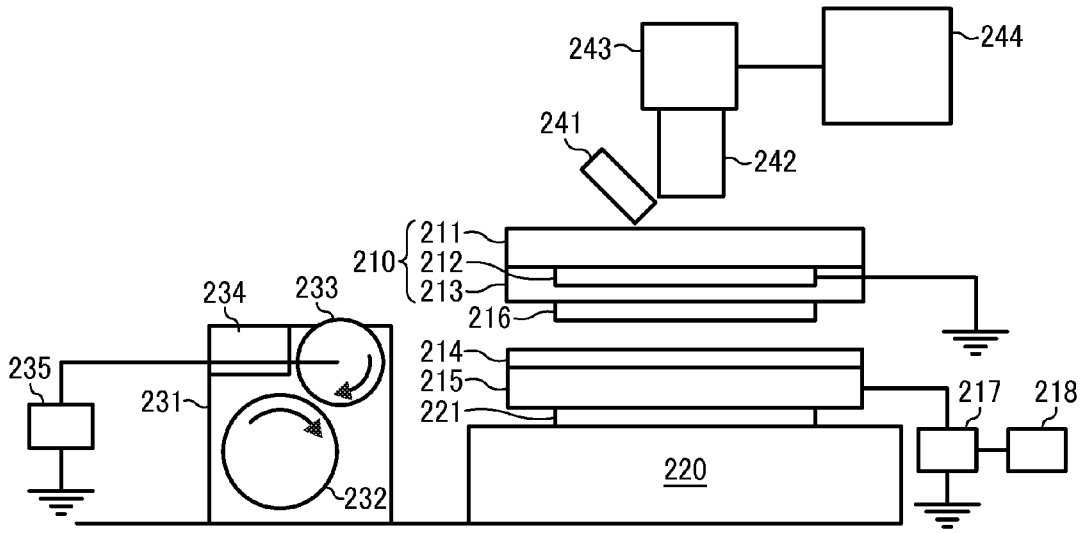
FIG. 6 is a schematic diagram illustrating an observation equipment for observation of behavior of toner in the secondary transfer nip.

The present inventors performed observation experiments using a special observation equipment shown in FIG. 6 to observe behavior of toner particles in the secondary transfer nip.

FIG. 6 is a schematic diagram illustrating the observation equipment for observation of behavior of toner in the secondary transfer nip. The observation equipment includes a transparent substrate 210, a developing device 231, a Z stage 220, a light source 241, a microscope 242, a high-speed camera 243, a personal computer 244, and so forth. The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212.

The transparent substrate 210 is supported at a predetermined height by a substrate support. The substrate support is allowed to move in the vertical and horizontal directions in the drawing by a moving assembly. In the illustrated example shown in FIG. 6, the transparent substrate 210 is located above the Z stage 220 including a metal plate 215 placed thereon. The transparent substrate 210 is capable of moving to a position directly above the developing device 231 disposed lateral to the Z stage 220, in accordance with the movement of the substrate support. The transparent electrode 212 of the transparent substrate 210 is connected to a grounded electrode fixed to the substrate support.

The developing device 231 has a similar configuration to the developing device 8K illustrated in FIG. 2 of the illustrative embodiment, and includes a screw 232, a developing roller 233, a doctor blade 234, and so forth. The developing roller 233 is rotated with a development bias applied thereto by a power source 235.

In accordance with the movement of the substrate support, the transparent substrate 210 is moved at a predetermined speed to a position directly above the developing device 231 and disposed opposite to the developing roller 233 with a predetermined gap therebetween. Then, toner on the developing roller 233 is transferred onto the transparent electrode 212 of the transparent substrate 210. Accordingly, a toner layer 216 having a predetermined thickness is formed on the transparent electrode 212 of the transparent substrate 210.

The toner adhesion amount per unit area relative to the toner layer 216 is adjustable by the toner density in the developing agent, the toner charge amount, the development bias value, the gap between the transparent substrate 210 and the developing roller 233, the moving speed of the transparent substrate 210, the rotation speed of the developing roller 233, and so forth.

The transparent substrate 210 on which the toner layer 216 is formed is translated to a position opposite to a recording medium 214 adhered to the planar metal plate 215 by a conductive adhesive. The metal plate 215 is placed on the substrate 221, which is provided with a load detector and placed on the Z stage 220. Furthermore, the metal plate 215 is connected to a voltage amplifier 217. The waveform generator 218 provides the voltage amplifier 217 with a transfer bias including a DC component and an AC component. The transfer bias is amplified by the voltage amplifier 217 and applied to the metal plate 215.

When the Z stage 220 is driven to elevate the metal plate 215, projecting portions of the recording medium 214 start coming into contact with the toner layer 216. When the Z stage 220 is driven to elevate the metal plate 215 further, a predetermined space is formed between recessed portions of the recording medium 214 and the toner layer 216. With the space maintained at a predetermined width, a transfer bias is applied to the metal plate 215, and the behavior of the toner is observed. After the observation, the Z stage 220 is driven to lower the metal plate 215 and separate the recording medium 214 from the transparent substrate 210. Thereby, a portion of the toner layer 216 is transferred onto the recording medium 214.

The behavior of the toner is examined using the microscope 242 and the high-speed camera 243 disposed above the transparent substrate 210. The transparent substrate 210 is formed of multiple layers including the glass plate 211, the transparent electrode 212, and the transparent insulating layer 213, which are all made of transparent material. It is therefore possible to observe, from above and through the transparent substrate 210, the behavior of the toner located under the transparent substrate 210.

In the present experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner on the transparent substrate 210 was photographed as follows. That is, the position at which the behavior of the toner is observed was irradiated with light by the light source 241, and the focus of the microscope 242 was adjusted. Then, a transfer bias was applied to the metal plate 215 to move the toner in the toner layer 216 adhering to the lower surface of the transparent substrate 210 toward the recording medium 214. The behavior of the toner in this process was photographed by the high-speed camera 243.

Under the above-described conditions, the behavior of the toner was photographed with the microscope 242 focused on the toner layer 216 on the transparent substrate 210, and the DC voltage (which corresponds to the offset voltage Voff in the illustrative embodiment) was set at 200 V, and the peak-to-peak voltage Vpp was set at 1000 V. The following behavior was observed. That is, the toner particles in the toner layer 216 moved back and forth between the transparent substrate 210 and the recording medium 214 due to an alternating electric field formed by the AC component of the transfer bias. With an increase in the number of the back-and-forth movements, the amount of toner particles moving back and forth was increased.

Figure 7:
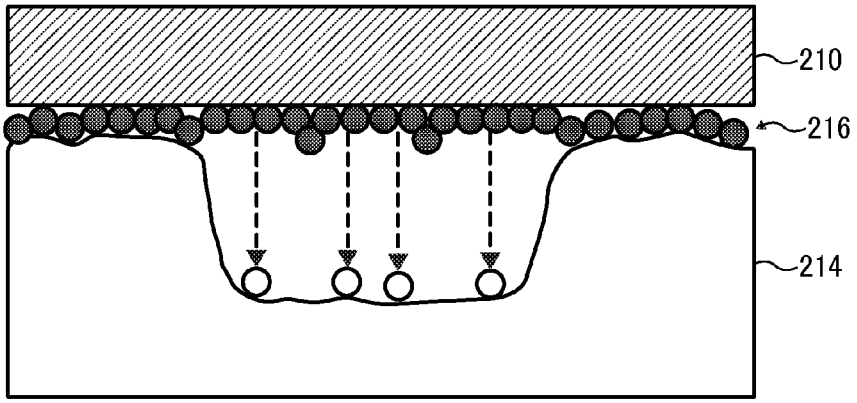
FIG. 7 is an enlarged schematic diagram illustrating behavior of toner in the secondary transfer nip at the beginning of transfer.
Figure 8:
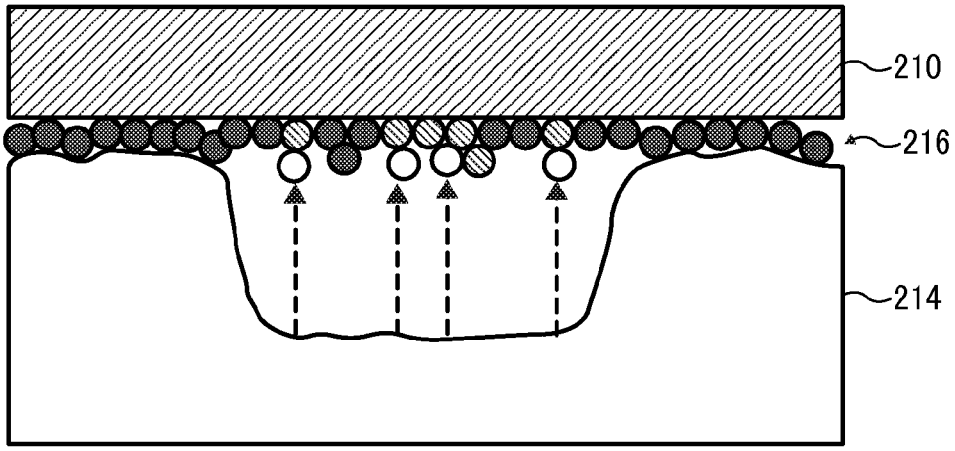
FIG. 8 is an enlarged schematic diagram illustrating behavior of the toner in the secondary transfer nip in the middle phase of transfer.

More specifically, in the transfer nip, there was one back-and-forth movement of toner particles in every cycle 1/f of the AC component of the transfer bias due to a single action of the alternating electric field. In the first cycle, only toner particles present on a surface of the toner layer 216 separated from the toner layer 216, as illustrated in FIG. 7. The toner particles then entered the recessed portions of the recording medium 214, and then returned to the toner layer 216, as illustrated in FIG. 8. In this process, the returning toner particles collided with other toner particles remaining in the toner layer 216, thereby reducing the adhesion of the other toner particles to the toner layer 216 or to the transparent substrate 210.

Figure 9:
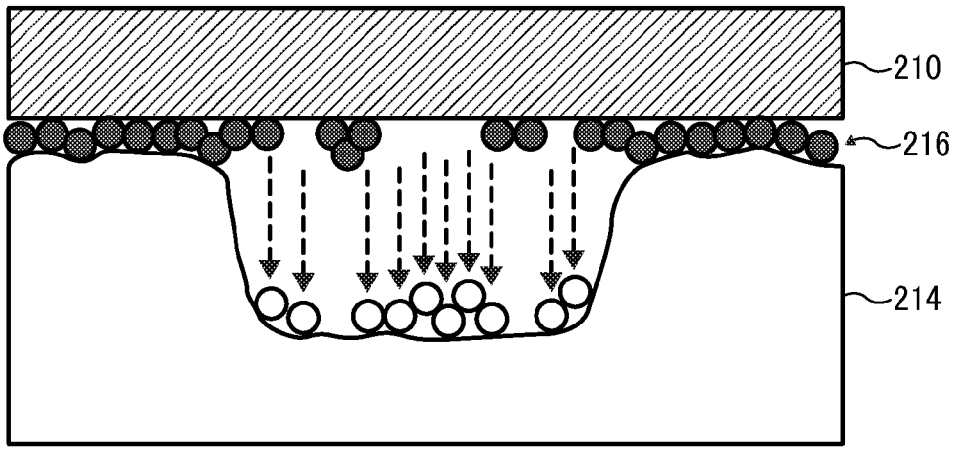
FIG. 9 is an enlarged schematic diagram illustrating behavior of toner in the secondary transfer nip in the last phase of transfer.

In the next cycle, therefore, a larger amount of toner particles than in the previous cycle separated from the toner layer 216, as illustrated in FIG. 9. The toner particles then entered the recessed portions of the recording medium 214, and then returned to the toner layer 216. In this process, the returning toner particles collided with other toner particles remaining in the toner layer 216, thereby reducing the adhesion of other toner particles to the toner layer 216 or to the transparent substrate 210.

In the next cycle, therefore, a larger amount of toner particles than in the previous cycle separated from the toner layer 216, as illustrated in FIG. 9 As described above, the number of toner particles moving back and forth was gradually increased in every back-and-forth movement.

Next, a description is provided of experiments performed by the present inventors with respect to the relations of toner adhesion amount per unit area of a toner image and the number of toner particles moving back and forth in the transfer nip.

The weight of toner constituting the toner layer 216 immediately after development and the weight of the toner particles moving back and forth are difficult to measure. Thus, a coverage plane area with the toner on the transparent electrode 212 in the observation area was employed as an index for finding out the ratio of toner moving back and forth. The coverage area with the toner within an observation area $A_o$ of the toner layer 216 immediately after being developed on the transparent substrate was measured as an initial coverage area $A_i$.

The transparent electrode 212 serves as a solid electrostatic latent image on the photoconductor. Thus, the toner layer 216 is similar to or the same as the solid toner image. However, the initial coverage area $A_i$ is substantially smaller than the observation area $A_o$, which indicates that although the toner layer 216 is similar to or the same as the solid toner image, there is an area to which toner particles are not adhered. In actual image forming apparatuses, when a solid electrostatic latent image is developed, obtaining a solid toner image and the solid toner image thus obtained is observed with a microscope prior to the fixing process, there is an area without the toner particles adhered thereto. This area is hereinafter referred to as a toner absence region.

With a normal toner adhesion amount, the toner particles are crushed in the fixing process, thereby expanding an area to which the toner particles adhere, to the toner absence region. By contrast, if the toner adhesion amount is reduced, the toner absence region partially remains even after the fixing process. The image density of the toner image changes in accordance with the area of the toner absence region. After the initial coverage area $A_i$ was measured, the transfer bias was applied to the metal plate 215 to transfer a portion of the toner layer 216 onto the recording medium 214.

It is to be noted that the following transfer bias was employed as a transfer bias:

Frequency f: 500 Hz

Vpp=1.2 kV

Voff=0 V

After transfer, the coverage area with residual toner remaining on the transparent electrode 212 in the observation area $A_o$ was measured as a residual-toner coverage area $A_r$. Subsequently, an active toner ratio $R_m$ (%) was obtained by the following formulas:

$$\theta_i=(A_i/A_o)\times 100$$

$R_m=[(A_i-A_r)/A_i]\times 100$, where $\theta_i$ is an initial coverage ratio % of a toner layer immediately after development, $R_m$ is a ratio of the active toner moving back and forth in the transfer nip.

The active toner ratio $R_m$ was obtained for different toner layers 216 with different toner adhesion amounts adjusted by the developing bias. The results are shown in Table 1.

TABLE 1

| | Rm | |
|---|---|---|
| $\theta_i$ | Back-and-Forth Movement: 5 times | Back-and-Forth Movement: 15 times |
| 15 | 8 | 10 |
| 25 | 15 | 25 |
| 40 | 35 | 50 |
| 50 | 50 | 60 |

In TABLE 1, the initial coverage ratio $\theta_i$ (%) represents a toner adhesion amount per dot constituting the toner image. For a solid image, the greater is the toner adhesion amount per dot, the higher is the initial coverage ratio $\theta_i$. As shown in TABLE 1, the lower is the initial coverage ratio $\theta_i$, the lower is the active toner ratio $R_m$. This indicates that when transferring the same amount of toner particles to the recessed portions of the recording medium P, as the toner adhesion amount per dot is reduced, the number of necessary back-and-forth movements of the toner particles in the transfer nip increases.

Next, a description is provided of a first transfer experiment performed by the present inventors.

A test machine having the same configurations as the image forming apparatus shown in FIG. 1 was used for the following experiments. Various printing tests were performed using the test machine. More specifically, in this test, the AC component of the secondary transfer bias was set as follows: Voff=−0.8 kV and Vpp=5.0 kV. The frequency f (Hz) of the AC component of the secondary transfer bias and the process liner velocity v were changed as needed.

TABLE 2 shows evaluation conditions and results of the first transfer experiment.

In the first transfer experiment, a solid black image as a test image was output onto a recording medium of regular paper (the surface thereof was relatively smooth) under a secondary transfer bias with different AC components (50~700 Hz) and different process linear velocities (141 mm/s and 282 mm/s). The resulting output image, the solid black image, was evaluated visually and graded. More specifically, when no unevenness of image density (pitch unevenness) synchronized with the frequency of the AC component of the secondary transfer bias was visible, it was graded as "GOOD", and when unevenness of image density (pitch unevenness) was visible, it was graded as "POOR".

TABLE 2

| | | FREQUENCY (Hz) | | | | | | | |
|---|---|---|---|---|---|---|---|---|---|
| | | 50 | 100 | 200 | 300 | 400 | 500 | 600 | 700 |
| LINEAR VELOCITY | 282 mm/s | POOR | POOR | POOR | POOR | GOOD | GOOD | GOOD | GOOD |
| | 141 mm/s | POOR | POOR | GOOD | GOOD | GOOD | GOOD | GOOD | GOOD |

As shown in TABLE 2, in a case in which the process linear velocity v was 282 mm/s, the pitch unevenness was prevented by setting the frequency f of the AC component of the secondary transfer bias to around 400 Hz, or greater than 400 Hz. In a case in which the process linear velocity v was 141 mm/s, the pitch unevenness was prevented by setting the frequency f of the AC component of the secondary transfer bias to around 200 Hz, or greater than 200 Hz.

In the first transfer experiment, because the number of alternating electric fields acting on the toner in the secondary transfer nip varies in accordance with the process linear velocity v, the lower threshold value of the frequency f of the AC component of the secondary transfer bias capable of preventing pitch unevenness varies. More specifically, the time s required for the toner to pass through the secondary transfer nip is expressed by the following formula:

s=w/v, where w is a width w (mm) of the secondary transfer nip at which the intermediate transfer belt 31 and the nip forming roller 36 contact directly in the direction of movement of the nip forming roller 36 in a state in which the recording medium P is not present in the secondary transfer nip.

Under the secondary transfer bias having the AC component with the frequency f (Hz), the cycle of AC component of the superimposed bias is expressed by "1/f". Therefore, during the time in which the toner passes through the secondary transfer nip, one cycle of the waveform of the AC component is applied a number of times expressed by "w×f/v".

The nip width w in the test machine was approximately 3 mm. As shown in TABLE 2, when the process linear velocity v was 282 mm/s, the lower threshold value of the frequency f of the AC component of the secondary transfer bias capable of preventing the pitch unevenness was 400 Hz. Therefore, the required number of times the waveform is applied can be calculated as approximately 4.26 times (3×400/282).

In other words, in the secondary transfer nip, the pitch unevenness can be prevented by causing the alternating electric field to act on the toner approximately 4.26 times. Furthermore, when the process linear velocity v was 141 mm/s, the lower threshold value of the frequency f of the AC component of the secondary transfer bias capable of preventing the pitch unevenness was 200 Hz. Therefore, the necessary number of times the waveform is applied can be calculated as approximately 4.26 times (3×200/141), which is the same as when the lower threshold value of the frequency was 400 Hz.

It is understood from the above that it is possible to obtain a favorable image free from pitch unevenness by causing the alternating electric field to act on the toner approximately four times while the toner passes through the secondary transfer nip. This indicates that in order to obtain a favorable image without pitch unevenness a condition of "w×f/v>4" needs to be satisfied.

As described above, the amount of toner transferred to the recessed portions of the recording medium surface is increased every back-and-forth movement of toner in the secondary transfer nip. In order to transfer adequately the toner to the recessed portions of the recording medium surface, the effective AC component needs to act on all the toner in the 50-line segment in the secondary transfer nip for at least two back-and-forth movements. That is, during the time in which the toner passes through the secondary transfer nip, it is necessary to apply one cycle of the waveform of the AC component at least twice. Thus, the condition expressed by "w×f/v>2" is necessary.

Thus, in order to adequately transfer toner to the recessed portions of the recording medium without pitch unevenness, it is necessary to set the frequency of the AC component of the secondary transfer bias to satisfy the following formula: w×f/v>4.

Next, a description is provided of a second transfer experiment performed by the present inventors.

In the test machine, the voltage Voff of the DC component of the secondary transfer bias was approximately −1.2 kV. The peak-to-peak voltage Vpp of the AC component was approximately 7 kV. As a recording medium, textured paper called "LEATHAC 66" (a trade name, manufactured by TOKUSHU PAPER MFG. CO., LTD.) having a ream weight (weight of 1000 sheets) of 260 kg was used.

TABLE 3 shows evaluation conditions and results of the second transfer experiment.

Figure 10:
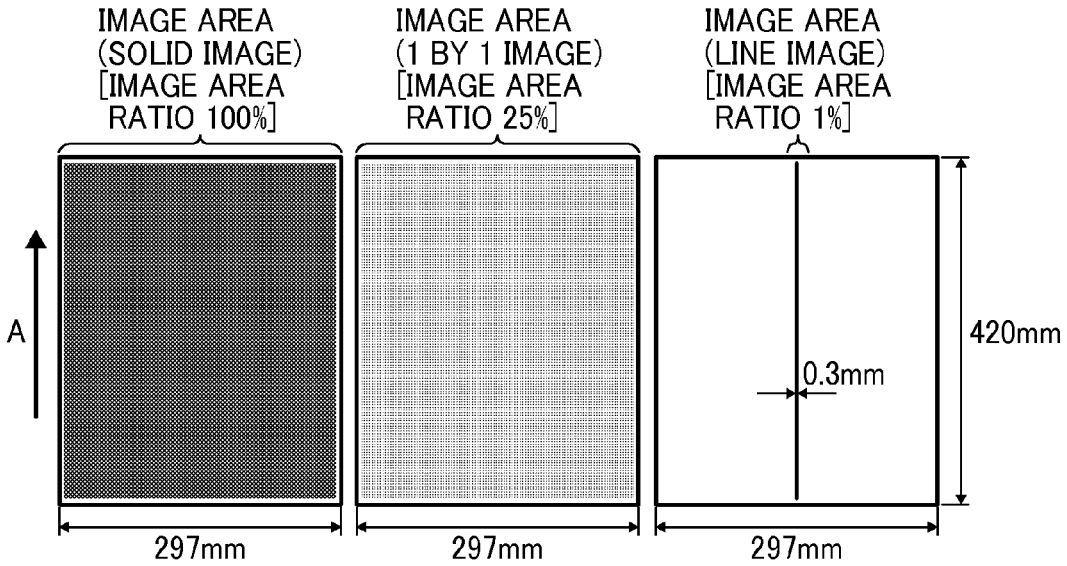
FIG. 10 is a schematic diagram illustrating images having different image area ratios according to an experiment shown in Table 3.

The following images were formed on recording media under different frequencies of the AC component of the secondary transfer bias, and evaluated. The frequencies were 0 (DC component only), 400 Hz, 600 Hz, and 1000 Hz. A solid black image (image area ratio of 100%) and a 1-by-1 halftone black image (image area ratio of 25%) were each formed on an entire surface of a recording medium. A line image with a width of 0.3 mm (image area ratio of 1%) was formed on a recording medium. FIG. 10 illustrates each image and the image area ratio. The image density at the recessed portions and degradation of image quality due to dust particles on the recording media were graded on a scale of 1.0 (lowest image quality) to 5.0 (highest image quality) in 0.5 increments.

TABLE 3

| | | FREQUENCY | | | |
|---|---|---|---|---|---|
| | | 0 (DC) | 400 | 600 | 1000 |
| SOLID BLACK IMAGE | DENSITY AT RECESSED PORTION | 1 | 4 | 4.5 | 5 |
| | TONER DUST | 5 | 5 | 5 | 5 |
| HALF TONE IMAGE | DENSITY AT RECESSED PORTION | 1 | 3.5 | 4 | 5 |
| | TONER DUST | 5 | 4 | 3.5 | 3 |
| LINE IMAGE | DENSITY AT RECESSED PORTION | 1 | 2 | 3 | 4 |
| | TONER DUST | 5 | 4 | 3 | 3 |

As shown in TABLE 3, the higher was the frequency of the AC component of the secondary transfer bias, the higher was the image density at the recessed portions. Furthermore, in a case in which the image area ratio was relatively low, as the frequency of the AC component of the secondary transfer bias was increased, the image quality was worsened gradually due to toner dust particles.

In order to prevent degradation of image quality caused by toner dust particles, it is necessary to reduce the frequency of the AC component of the secondary transfer bias. However, when the image area ratio is relatively low, reducing the frequency of the AC component of the secondary transfer bias causes inadequate toner density at the recessed portions of the recording medium.

In view of the above, in a case in which the image area ratio is relatively high, such as when the image area ratio is approximately 50%, even when the frequency of the AC component of the secondary transfer bias is reduced, a favorable toner density can be obtained at the recessed portions of the recording medium. Therefore, higher priority is given to prevention of degradation of image quality caused by toner dust particles, and hence the frequency of the AC component of the secondary transfer bias is reduced.

Furthermore, in a case in which the image area ratio is very low, such as when the image area ratio is 5%, higher priority is given to securing the toner density at the recessed portions of the recording medium, and hence the frequency of the AC component of the secondary transfer bias is increased. In a case in which the image area ratio is relatively high such as a single-color solid image (image area ratio of 100%), toner dust particles are not noticeable, and hence the frequency of the AC component of the secondary transfer bias is increased. With this configuration, while maintaining the toner density at the recessed portions of the recording medium as much as possible, degradation of image quality due to toner dust particles can be suppressed, if not prevented entirely.

Figure 11:
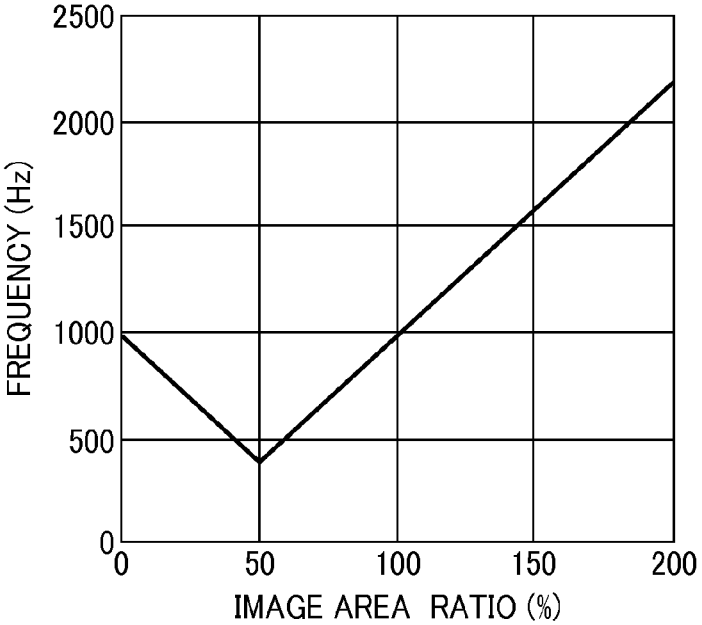
FIG. 11 is a graph showing relations between an image area ratio and a frequency of an AC component of the secondary transfer bias.

FIG. 11 is a graph showing relations between the image area ratio and the frequency of the AC component of the secondary transfer bias. In a case in which the image area ratio is relatively high, for example, 50%, the frequency of the AC component of the secondary transfer bias is reduced. In a case in which the image area ratio is relatively low, for example, 5%, the frequency of the AC component of the secondary transfer bias is increased. In a case in which the image area ratio is high, for example, 100%, the frequency of the AC component of the secondary transfer bias is increased. The frequency f of the AC component of the transfer bias is expressed as a function of the image area ratio A, that is, expressed as f(A).

In other words, when the image area ratio is Amin % (for example, 50% in FIG. 11), that is, between 0% and 100% (i.e., a single-color solid image), setting the frequency of the AC component of the secondary transfer bias to the lowest value can achieve favorable image quality irrespective of the image area ratio. It is to be noted that that in order to prevent pitch unevenness, as described above in the second transfer experiment, because the nip width w is 3 mm and the process linear velocity v is 282 mm/s in the test machine, the lower threshold value of the frequency of the AC component of the secondary transfer bias capable of preventing the pitch unevenness is set to 400 Hz.

Figure 12:
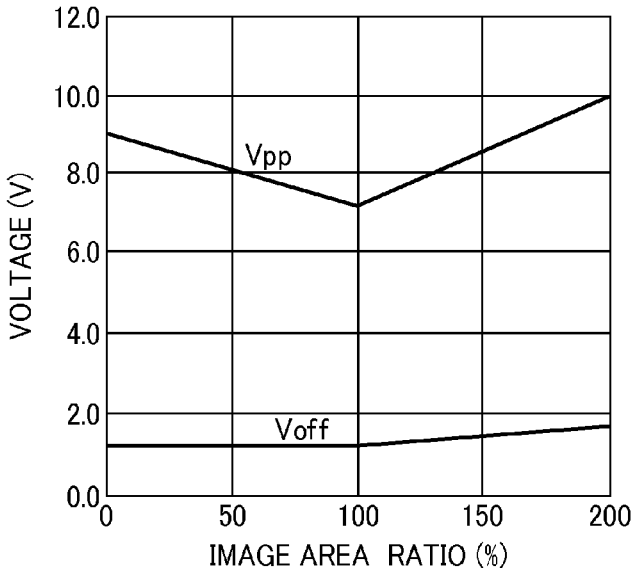
FIG. 12 is a graph showing a relation between the image area ratio, a peak-to-peak voltage Vpp, and a voltage Voff of a DC component of the secondary transfer bias.
Figure 13:
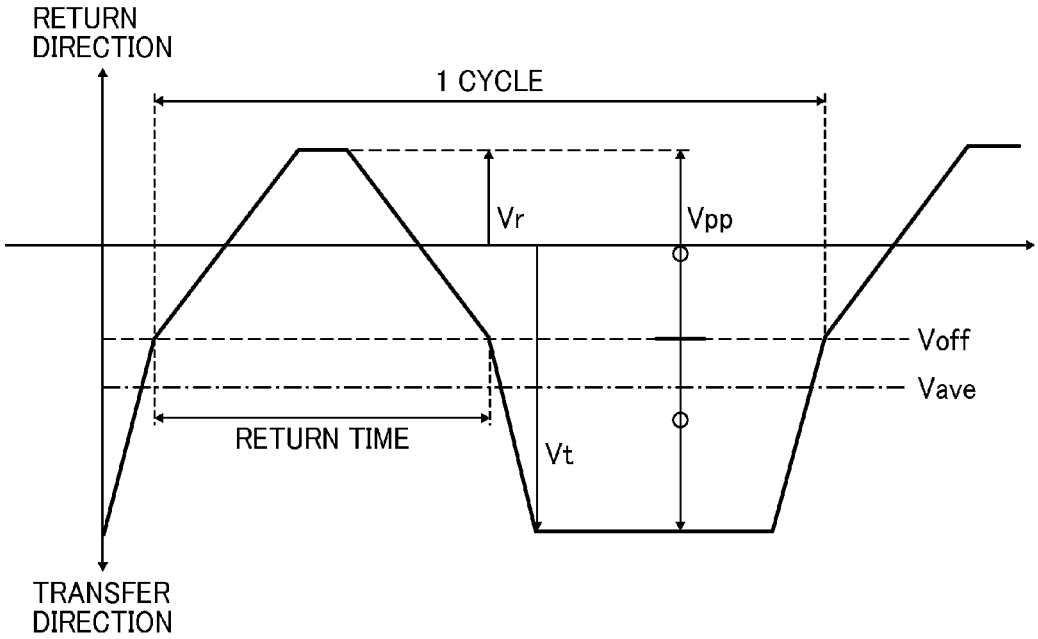
FIG. 13 is a waveform chart showing another example of a waveform of the secondary transfer bias.

Alternatively, in some embodiments, not only the frequency of the AC component of the secondary transfer bias is changed in accordance with the image area ratio, but also the peak-to-peak voltage Vpp of the AC component of the secondary transfer bias and/or the voltage Voff of the DC component of the secondary transfer bias are changed in accordance with the image area ratio as illustrated in FIG. 12.

In general, as the toner adhesion amount increases, the peak-to-peak voltage Vpp and the voltage Voff need to be increased. Therefore, as the image area ratio increases, the peak-to-peak voltage Vpp and the voltage Voff are increased.

As described above, in a case in which the image area ratio is relatively low, such as a line image, transferability of toner at the recessed portions on the recording medium is not good. In this case, the peak-to-peak voltage Vpp is increased so as to increase the transfer electric field for back-and-forth movement of the toner and maintain the transferability of toner at the recessed portions of the recording medium. That is, as the image area ratio is equal to or less than a certain value (for example, 100% or less in FIG. 12), the peak-to-peak voltage Vpp is increased.

As the image area ratio is equal to or greater than a certain value (for example, 100% or greater in FIG. 12), the peak-to-peak voltage Vpp is increased. With this configuration, for both a halftone image and a solid image toner can be transferred well to the recessed portions of the recording medium.

The present inventors performed a third transfer experiment to confirm an effect of changing the peak-to-peak voltage Vpp of the AC component of the secondary transfer bias and the voltage Voff of the DC component of the secondary transfer bias in accordance with the image area ratio. A description is provided of the transfer experiment performed by the present inventors below.

TABLE 4 shows evaluation conditions and results of the third transfer experiment.

In TABLE 4, EMBODIMENT 1 refers to changing the frequency of the AC component of the secondary transfer bias in accordance with the image area ratio. In TABLE 4, EMBODIMENT 2 refers to changing the frequency of the AC component of the secondary transfer bias in accordance with the image area ratio as shown in FIG. 11 as well as changing the peak-to-peak voltage Vpp and the voltage Voff in accordance with the image area ratio as shown in FIG. 12. COMPARATIVE EXAMPLE 1 refers to having a constant frequency of the AC component of the secondary transfer bias at 400 Hz.

In Embodiment 1 and Comparative Example 1, the voltage Voff of the DC component of the secondary transfer bias and the peak-to-peak voltage Vpp of the AC component of the secondary transfer bias were constant. That is, Voff was −1.2 kV, and Vpp was 7 kV. The following images were formed on recording media under the three conditions, and evaluated. A 1-by-1 halftone black image (image area ratio of 25%) was formed on an entire surface of a recording medium. A line image with a width of 0.3 mm (image area ratio of 1%) was formed on a recording medium. The image density at the recessed portions and degradation of image quality due to toner dust particles on the recording media were graded on a scale of 1.0 (lowest image quality) to 5.0 (highest image quality) in 0.5 increments.

TABLE 4

| | | COMPARATIVE EXAMPLE 1 | EMBODIMENT 1 | EMBODIMENT 2 |
|---|---|---|---|---|
| SOLID BLACK IMAGE | DENSITY AT RECESSED PORTION | 4 | 5 | 5 |
| | TONER DUST | 5 | 5 | 5 |
| HALFTONE IMAGE | DENSITY AT RECESSED PORTION | 3.5 | 4 | 4.5 |
| | TONER DUST | 4 | 4 | 4 |
| LINE IMAGE | DENSITY AT RECESSED PORTION | 2 | 3.5 | 4 |
| | TONER DUST | 4 | 3 | 3 |

As shown in TABLE 4, in Embodiment 1 as compared with Comparative Example 1, favorable results were obtained for the toner density at the recessed portions and the degradation of image quality due to toner dust particles with respect to all image area ratios. As shown in TABLE 4, in Embodiment 2, even more favorable results than Embodiment 1 were obtained for the toner density at the recessed portions and the degradation of image quality due to toner dust particles with respect to all image area ratios. Adjusting the frequency of the AC component of the secondary transfer bias, the peak-to-peak voltage Vpp of the AC component of the secondary transfer bias and the voltage Voff of the DC component of the secondary transfer bias in accordance with the image area ratio is effective.

Alternatively, in some embodiments, the frequency of the AC component of the secondary transfer bias, the peak-to-peak voltage Vpp of the AC component of the secondary transfer bias and the voltage Voff of the DC component of the secondary transfer bias are adjusted in accordance with a structure of an image. Whether the image is a solid image or a halftone image is taken into account even when the image area ratios are the same, more favorable image quality can be achieved.

When the waveform of the secondary transfer bias is a sinusoidal wave which is symmetrical, as illustrated in FIG. 3, the time-averaged voltage Vave of the secondary transfer bias and the voltage Voff of the DC component of the secondary transfer bias coincide with each other. In this case, the return peak potential Vr is expressed by the following equation:

$$Vr=Vpp/2-|Voff|, \text{ where } Voff \text{ is an absolute value.}$$

According to the third experiment, the present inventors have recognized that when the waveform of the secondary transfer bias is a sinusoidal wave, preferably, Vpp and Voff satisfy the following relation in order to secure a return peak potential Vr necessary for the back-and-forth movement of toner: $Vpp>4\times|Voff|$ With this configuration, a favorable image density is obtained at the recessed portions of the recording medium.

[Variation]

With reference to FIGS. 13 through 19, a description is provided of variations of the waveform of the secondary transfer bias according to the illustrative embodiment of the present disclosure.

FIGS. 13 through 19 illustrate variations of the waveform of the secondary transfer bias.

When the waveform of the secondary transfer bias is a sinusoidal wave, the time-averaged voltage Vave of the secondary transfer bias and the voltage Voff of the DC component of the secondary transfer bias are substantially the same. In this case, as described above, the return peak potential Vr is expressed by "$Vr=Vpp/2-|Voff|$". In order to secure a necessary return peak potential Vr for the back-and-forth movement of toner, the peak-to-peak voltage Vpp of the secondary transfer bias needs to be increased to a relatively high level. Vpp is expressed by "$Vpp=Vt+Vr$" (See FIG. 3) Consequently, with an increase in the peak-to-peak voltage Vpp, the transfer peak potential Vt also increases. However, in the case of a large toner adhesion amount and a high resistance of the recording medium, with an increase in the transfer peak potential Vt a trace of electrical discharge is generated in an image more easily.

When the waveform of the secondary transfer bias is a sinusoidal wave, in order to prevent the transfer peak potential Vt from increasing more than necessary, a certain level of the peak-to-peak voltage Vpp of the secondary transfer bias needs be maintained and the absolute value of the voltage Voff of the DC component of the secondary transfer bias (i.e., the absolute value of the time-averaged voltage Vave of the secondary transfer bias) needs to be relatively small.

In FIGS. 13 through 19, a transfer time refers to a time in one cycle of the waveform of the secondary transfer bias on the transfer direction side from the voltage Voff of the DC component of the secondary transfer bias. The transfer direction refers to a direction in which the toner is transferred onto a recording medium. A return time refers to a time in one cycle of the waveform of the secondary transfer bias on the return direction side from the voltage Voff of the DC component of the secondary transfer bias. The return direction refers to a direction in which the toner is returned to the secondary-transfer back surface roller 33 (shown in FIG. 1).

An area of the waveform on the return direction side from the voltage Voff of the DC component of the secondary transfer bias is smaller than the area of the waveform on the transfer direction side by reducing a ratio (Duty ratio) of the return time to one cycle of the waveform of the secondary transfer bias (i.e., a sum of the return time and the transfer time). This configuration can keep the transfer peak potential Vt under a certain level while increasing the time-averaged voltage Vave of the secondary transfer bias.

Figure 14:
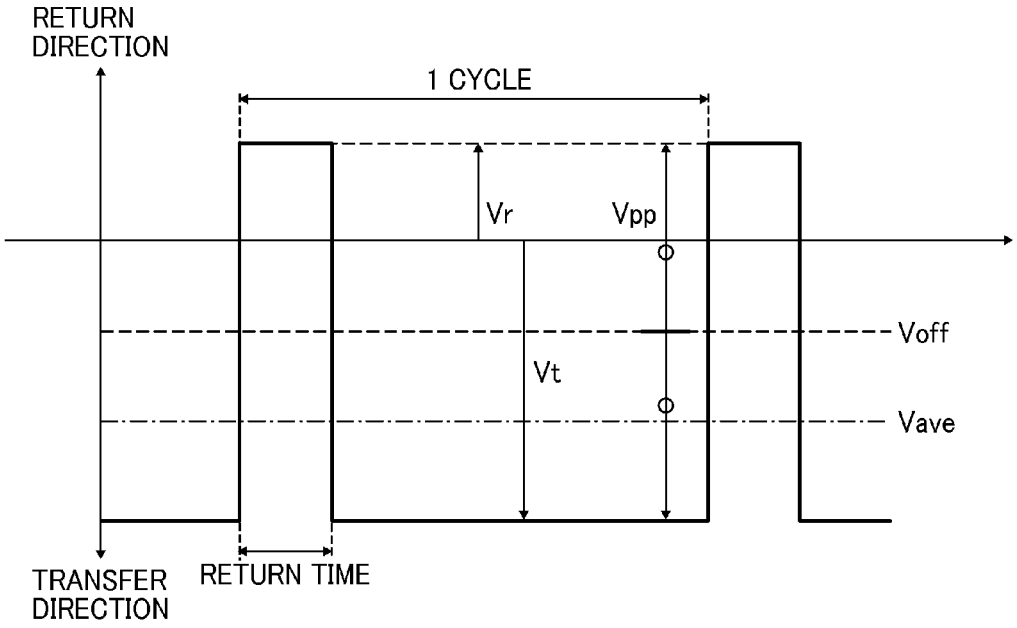
FIG. 14 is a waveform chart showing another example of a waveform of the secondary transfer bias.
Figure 15:
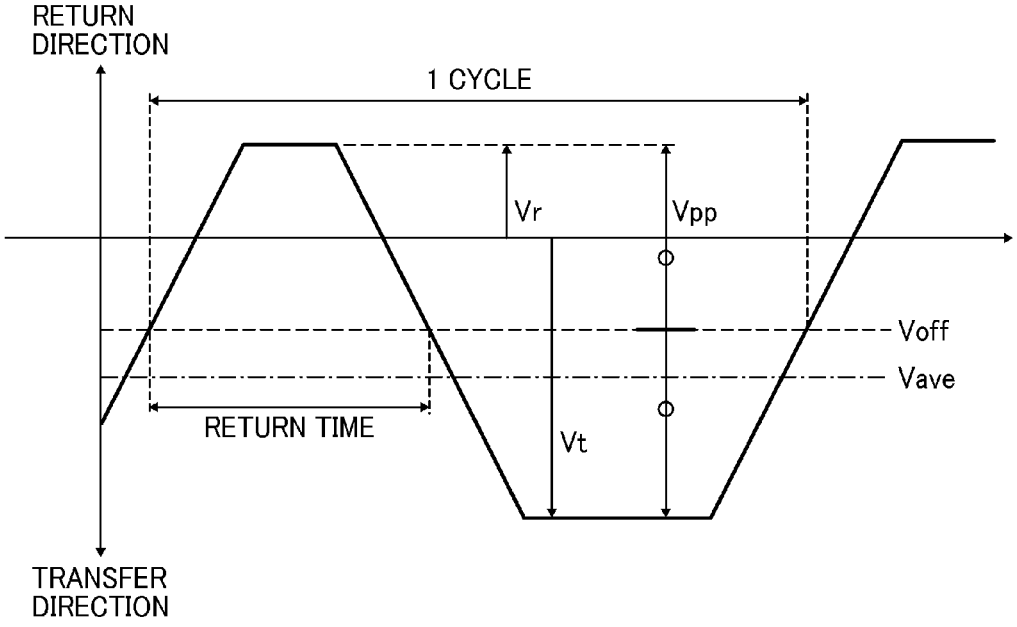
FIG. 15 is a waveform chart showing another example of a waveform of the secondary transfer bias.
Figure 16:
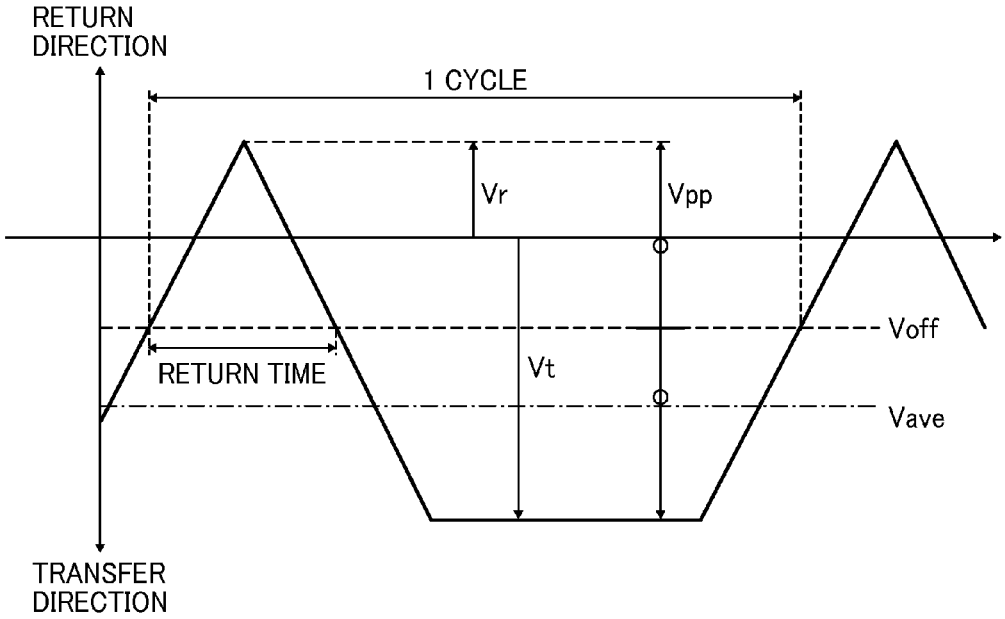
FIG. 16 is a waveform chart showing another example of a waveform of the secondary transfer bias.
Figure 17:
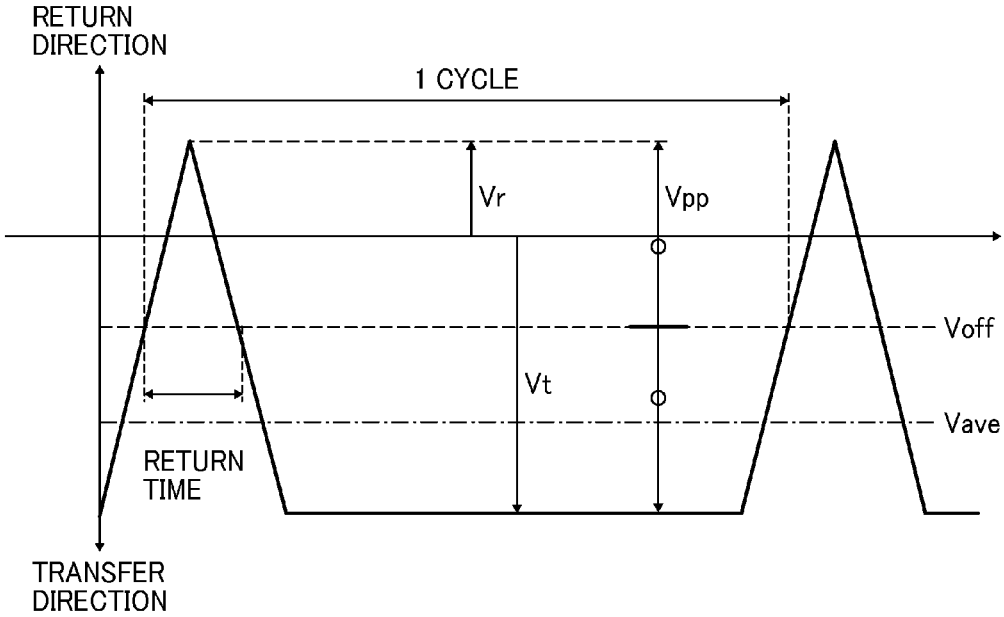
FIG. 17 is a waveform chart showing another example of a waveform of the secondary transfer bias.
Figure 18:
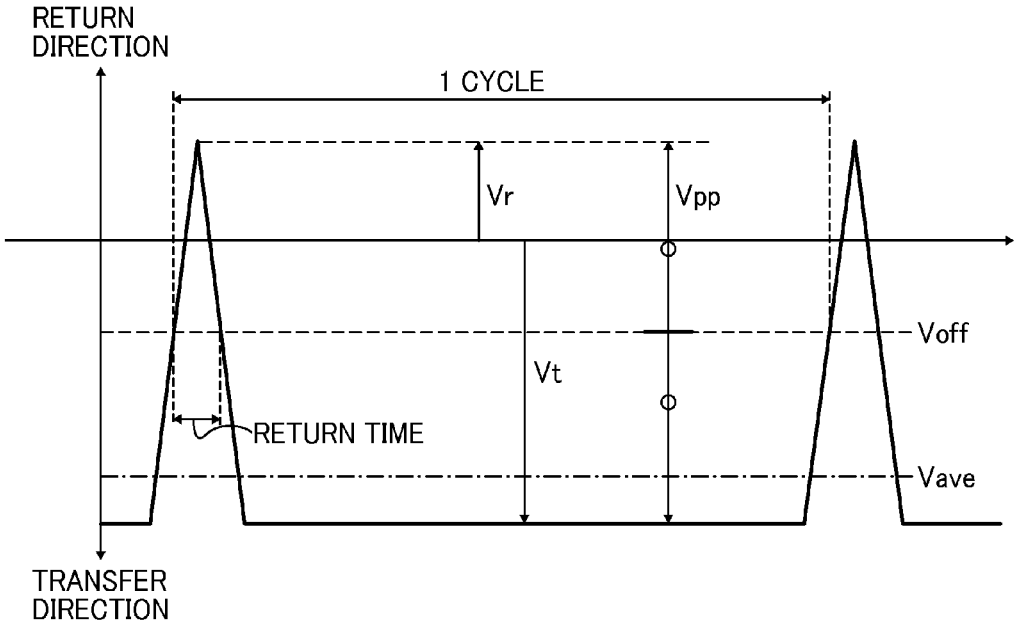
FIG. 18 is a waveform chart showing another example of a waveform of the secondary transfer bias.
Figure 19:
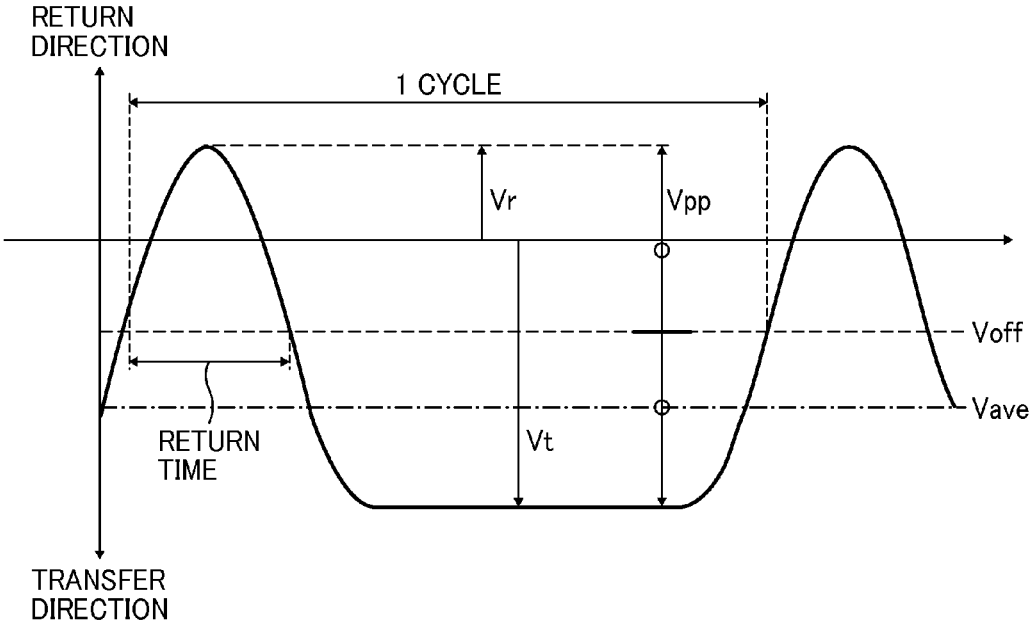
FIG. 19 is a waveform chart showing another example of a waveform of the secondary transfer bias.

In the example shown in FIG. 14, the waveform has a square wave and the duty ratio is 16%. With this configuration, the transfer peak potential Vt is maintained at −3.0 kV at which the trace of electrical discharge is not generated in the image while maintaining the return peak potential Vr at +2.0 kV which is necessary for the back-and-forth movement of the toner.

Although the embodiment of the present disclosure has been described above, the present disclosure is not limited to the foregoing embodiments, but a variety of modifications can naturally be made within the scope of the present disclosure.

[Aspect A]

An image forming apparatus includes an image bearer to bear a toner image, a toner image forming device to form the toner image on the image bearer, a nip forming device to contact the image bearer to form a transfer nip between the image bearer and the nip forming device, a transfer bias output device to output a transfer bias including a direct current (DC) component and an alternating current (AC) component to transfer the toner image from the image bearer onto a recording medium interposed in the transfer nip, and a controller operatively connected to the transfer bias output device to adjust a frequency f of the AC component of the transfer bias in accordance with an image area ratio A such that the frequency f is at its minimum under a predetermined image area ratio Amin %, where Amin % is greater than 0 but lower than an image area ratio of a solid image. The frequency f of the AC component of the transfer bias is expressed as a function of the image area ratio A, that is, expressed as f(A).

In order to prevent degradation of image quality due to toner dust particles, it is necessary to keep the frequency of the AC component of the secondary transfer bias low. However, a lower frequency of the AC component of the secondary transfer bias when the image area ratio is relatively low prevents the recessed portions of the recording medium from obtaining an adequate toner density.

For example, in a case in which the image area ratio is very low, such as when the image area ratio is approximately 5%, higher priority is given to obtaining a favorable toner density at the recessed portions of the recording medium, and hence the frequency of the AC component of the secondary transfer bias is increased. In a case in which the image area ratio is high such as a single-color solid image (image area ratio of 100%), toner dust particles are not noticeable, and hence the frequency of the AC component of the secondary transfer bias is increased. In a case in which the image area ratio is between the two (for example, image area ratio of 50%), a favorable toner density can still be obtained at the recessed portions of the recording medium even when the frequency of the AC component of the secondary transfer bias is lowered.

Therefore, higher priority is given to prevention of degradation of image quality caused by toner dust particles, and hence the frequency of the AC component of the secondary transfer bias is reduced. That is, when the image area ratio Amin (%) is higher than 0% but lower than the image area ratio of a solid image, setting the frequency of the AC component of the secondary transfer bias to the lowest value can obtain a favorable image density at the recessed portions of the recording medium as much as possible while preventing degradation of image quality.

[Aspect B]

In the image forming apparatus according to Aspect A, the following relation is satisfied: $f>4\times v/w$, where f is a minimum frequency of the AC component of the transfer bias in Herz (Hz), w is a width of the transfer nip in millimeter (mm), and v is a linear velocity of the image bearer in millimeters per second (mm/s).

According to the experiments performed by the present inventors, in order to prevent pitch unevenness in an image, it is necessary to set the frequency of the AC component of the secondary transfer bias to always satisfy the following equation: $f>4\times v/w$. With this configuration, a favorable image without pitch unevenness is obtained.

[Aspect C]

In the image forming apparatus according to Aspect A or Aspect B, the controller adjusts, in accordance with the image area ratio, one of a peak-to-peak voltage Vpp of the AC component of the transfer bias and an offset voltage Voff of the AC component of the transfer bias to be applied to the nip forming device.

In general, as the toner adhesion amount increases, the peak-to-peak voltage Vpp and the voltage Voff need to be increased. Therefore, as the image area ratio increases, the peak-to-peak voltage Vpp and the voltage Voff are increased. Furthermore, in a case in which the image area ratio is relatively low, such as a line image, toner is not transferred well to the recessed portions of the recording medium. Thus, it is necessary to increase the peak-to-peak voltage Vpp to increase the transfer electric field for the back-and-forth movement of the toner and to transfer toner to the recessed portions adequately.

The frequency of the AC component of the secondary transfer bias as well as the peak-to-peak voltage Vpp and the offset voltage Voff are adjusted in accordance with the image area ratio. With this configuration, transferability of toner at the recessed portions of the recording medium can be enhanced for both a halftone image and a solid image.

[Aspect D]

In the image forming apparatus according to any one of Aspects A through C, a time-averaged voltage Vave of the AC component of the transfer bias is equal to the offset voltage Voff, and the peak-to-peak voltage Vpp satisfies the following relation: $Vpp>4\times|Voff|$.

According to the experiments performed by the present inventors, in order to secure the return peak potential Vr necessary for the back-and-forth movement of toner when the waveform of the secondary transfer bias has a sinusoidal wave, preferably, Vpp and Voff satisfy the following relation: Vpp>4×|Voff|. With this configuration, a favorable image density is obtained at the recessed portions of the recording medium.

[Aspect E]

In the image forming apparatus according to any one of Aspects A through D, a time during which a potential difference that generates an electric field causing toner to move from the image bearer to a recording medium in a transfer direction acts in the transfer nip is longer than a time during which a potential difference that generates an electric field causing the toner to return from the recording medium to the image bearer in a return direction acts in the transfer nip.

When the waveform of the secondary transfer bias is a sinusoidal wave, the time-averaged voltage Vave of the secondary transfer bias and the voltage Voff of the DC component of the secondary transfer bias are substantially the same. In this case, the return peak potential Vr is expressed by "Vr=Vpp/2−|Voff|". In order to secure the return peak potential Vr necessary for the back-and-forth movement of toner, the peak-to-peak voltage Vpp of the secondary transfer bias needs to be increased to a relatively high level.

Furthermore, the peak-to-peak voltage Vpp is expressed by Vpp=Vt+Vr. Consequently, with an increase in the peak-to-peak voltage Vpp, the transfer peak potential Vt also increases. However, in the case of a large toner adhesion amount and the recording medium having a high resistance, with an increase in the transfer peak potential Vr a trace of electrical discharge is generated in an image more easily.

When the waveform of the secondary transfer bias is a sinusoidal wave, in order to prevent the transfer peak potential Vt from increasing more than necessary, the peak-to-peak voltage Vpp of the secondary transfer bias needs not to exceed a certain level and the absolute value of the voltage Voff of the DC component of the secondary transfer bias (i.e., the absolute value of the time-averaged voltage Vave of the secondary transfer bias) needs to be relatively small.

Furthermore, the area of the waveform on the return direction side from the voltage Voff of the DC component of the secondary transfer bias is smaller than the area of the waveform on the transfer direction side by reducing a ratio (Duty ratio) of the return time to one cycle of the waveform of the secondary transfer bias (i.e., a sum of the return time and the transfer time). This configuration keeps the transfer peak potential Vt low while keeping the time-averaged voltage Vave of the secondary transfer bias high.

According to an aspect of this disclosure, the present disclosure is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer to bear a toner image;

a toner image forming device to form the toner image on the image bearer;

a nip forming device to contact the image bearer to form a transfer nip between the image bearer and the nip forming device;

a transfer bias output device to output a transfer bias including a direct current (DC) component and an alternating current (AC) component to transfer the toner image from the image bearer onto a recording medium interposed in the transfer nip; and a controller to relatively adjust a frequency of the AC component of the transfer bias and an image area ratio, wherein the following relations are satisfied:

when the image area ratio is relatively increasing below a set value, the frequency is relatively reduced, when the image area ratio reaches the set value, the frequency is set to a relatively lowest frequency, and when the image area ratio is relatively increasing above the set value, the frequency is relatively increased.

2. The image forming apparatus according to claim 1, wherein the following relation is satisfied:

f>4×v/w, where f is a frequency of the AC component of the transfer bias in Hertz (Hz), w is a width of the transfer nip in millimeter (mm), and v is a linear velocity of the image bearer in millimeters per second (mm/s).

3. The image forming apparatus according to claim 1, wherein the controller is configured to additionally adjust, in accordance with the image area ratio, one of a peak-to-peak voltage Vpp of the AC component of the transfer bias and an offset voltage Voff of the AC component of the transfer bias to be applied to the nip forming device.

4. The image forming apparatus according to claim 1, wherein a time-averaged voltage Vave of the AC component of the transfer bias is equal to an offset voltage Voff of the AC component of the transfer bias, and a peak-to-peak voltage Vpp of the AC component of the transfer bias satisfies the following relation: Vpp>4×|Voff|.

5. The image forming apparatus according to claim 1, wherein a time during which a potential difference that generates an electric field causing toner to move from the image bearer to a recording medium in a transfer direction acts is relatively longer than a time during which a potential difference that generates an electric field causing the toner to return from the recording medium to the image bearer in a return direction acts in the transfer nip.

6. The image forming apparatus according to claim 2, wherein a time-averaged voltage Vave of the AC component of the transfer bias is equal to the offset voltage Voff of the AC component of the transfer bias, and the peak-to-peak voltage Vpp of the AC component of the transfer bias satisfies the following relation: $Vpp>4\times|Voff|$.

7. The image forming apparatus according to claim 2, wherein the controller is configured to additionally adjust, in accordance with the image area ratio, one of a peak-to-peak voltage Vpp of the AC component of the transfer bias and an offset voltage Voff of the AC component of the transfer bias to be applied to the nip forming device.

8. The image forming apparatus according to claim 3, wherein a time-averaged voltage Vave of the AC component of the transfer bias is equal to an offset voltage Voff of the AC component of the transfer bias, and a peak-to-peak voltage Vpp of the AC component of the transfer bias satisfies the following relation: $Vpp>4\times|Voff|$.

* * * * *